US009700784B1

(12) United States Patent
Krumel

(10) Patent No.: US 9,700,784 B1
(45) Date of Patent: Jul. 11, 2017

(54) METHOD OF PLAYING A CARD GAME AS A CASINO STYLE GAME, SLOT MACHINE OR VIDEO GAME

(76) Inventor: Dale Paul Krumel, Pensacola, FL (US)

( * ) Notice: Subject to any disclaimer, the term of this patent is extended or adjusted under 35 U.S.C. 154(b) by 672 days.

(21) Appl. No.: 12/459,439

(22) Filed: Jul. 1, 2009

Related U.S. Application Data

(63) Continuation-in-part of application No. 11/150,454, filed on Jun. 10, 2005, now abandoned.

(51) Int. Cl.
*A63F 1/00* (2006.01)

(52) U.S. Cl.
CPC ..... *A63F 1/00* (2013.01)

(58) Field of Classification Search
CPC ..... A63F 1/00
USPC ..... 273/292
See application file for complete search history.

(56) References Cited

U.S. PATENT DOCUMENTS

| | | | | |
|---|---|---|---|---|
| 3,667,757 | A | 6/1972 | Holmberg | |
| 4,861,041 | A | 8/1989 | Jones et al. | |
| 5,098,107 | A | 3/1992 | Boylan et al. | |
| 5,240,249 | A * | 8/1993 | Czarnecki et al. | |
| 5,265,882 | A | 11/1993 | Malek | |
| 5,322,295 | A * | 6/1994 | Cabot et al. | 273/292 |
| 5,328,189 | A * | 7/1994 | Malek | 273/292 |
| 5,395,120 | A | 3/1995 | Malek | |
| 5,417,430 | A | 5/1995 | Breeding | |
| 5,486,005 | A * | 1/1996 | Neal | 273/292 |
| 5,685,774 | A * | 11/1997 | Webb | 463/13 |
| 5,901,958 | A * | 5/1999 | Andrews | 273/292 |
| 6,102,402 | A * | 8/2000 | Scott et al. | 273/292 |
| 6,554,282 | B2 * | 4/2003 | VanderKley et al. | 273/292 |
| 6,689,979 | B1 * | 2/2004 | Bach et al. | 218/40 |
| 6,824,137 | B2 * | 11/2004 | Foster et al. | 273/292 |
| 7,004,467 | B2 * | 2/2006 | Lo | 273/292 |
| 7,011,309 | B2 * | 3/2006 | Soltys et al. | 273/149 R |
| 7,195,243 | B2 * | 3/2007 | Kenny et al. | 273/292 |
| 7,229,075 | B2 * | 6/2007 | Foster et al. | 273/292 |
| 7,309,065 | B2 * | 12/2007 | Yoseloff et al. | 273/292 |
| 7,316,615 | B2 * | 1/2008 | Soltys et al. | 463/25 |
| 7,980,933 | B2 * | 7/2011 | Kennedy | 463/12 |
| 8,196,929 | B2 * | 6/2012 | Brunelle | 273/292 |
| 8,210,539 | B2 * | 7/2012 | Brunelle | 273/292 |
| 8,221,209 | B2 * | 7/2012 | Herrmann et al. | 463/16 |
| 8,246,049 | B1 * | 8/2012 | Martens et al. | 273/292 |
| 2001/0045398 | A1 * | 11/2001 | Messier | 210/764 |
| 2002/0063388 | A1 * | 5/2002 | Lo | 273/292 |

(Continued)

*Primary Examiner* — Aarti B Berdichevsky
*Assistant Examiner* — Dolores Collins
(74) *Attorney, Agent, or Firm* — J. Nevin Shaffer, Jr.

(57) ABSTRACT

A playing card wagering game method which involves players placing a three part wager and utilizing the standard counting technique of cribbage. Cards are dealt four down to all players that ante and the dealer. Players inspect their cards and are given the choice of folding (withdrawing from the game) or placing a second wager. A common fifth card is revealed and upon inspection players are again given the choice of folding or placing a third wager. After each player decides on whether to fold or stay, the dealer then reveals dealer's cards. Dealer maintains a point requirement to open. All remaining players which did not fold are then resolved where the highest hand (initial four dealt cards including common card) wins and tying hands push. Player's winning hands are paid in accordance with paytables.

39 Claims, 9 Drawing Sheets

(56) References Cited

U.S. PATENT DOCUMENTS

| | | | | |
|---|---|---|---|---|
| 2002/0163128 | A1* | 11/2002 | Lo | 273/292 |
| 2003/0034610 | A1* | 2/2003 | VanderKley et al. | 273/292 |
| 2004/0090006 | A1* | 5/2004 | Foster et al. | 273/292 |
| 2005/0073101 | A1* | 4/2005 | Foster et al. | 273/292 |
| 2005/0218596 | A1* | 10/2005 | Adam et al. | 273/292 |
| 2005/0242506 | A1* | 11/2005 | Yoseloff | 273/292 |
| 2006/0027968 | A1* | 2/2006 | Snow | 273/292 |
| 2008/0157475 | A1* | 7/2008 | Brunelle | 273/292 |
| 2009/0026707 | A1* | 1/2009 | Lo | 273/303 |
| 2012/0098195 | A1* | 4/2012 | Massie | 273/274 |

* cited by examiner

Figure 8: Three Tier Game Payouts

| Points | BET Payout |
|---|---|
| 4-10 | 1 to 1 |
| 11-12 | 2 to 1 |
| 13-14 | 4 to 1 |
| 15-16 | 8 to 1 |
| 17-18 | 10 to 1 |
| 20-22 | 20 to 1 |
| 23-24 | 25 to 1 |
| 28 | 50 to 1 |
| 29 | 200 to 1 |

Figure 9: Two Tier Game Payouts

| Points | BET Payout |
|---|---|
| 4-10 | 1 to 1 |
| 11-12 | 2 to 1 |
| 13-14 | 3 to 1 |
| 15-16 | 6 to 1 |
| 17-18 | 8 to 1 |
| 20-22 | 16 to 1 |
| 23-24 | 25 to 1 |
| 28 | 50 to 1 |
| 29 | 200 to 1 |

Figure 10: Single Wager First Four Payouts

| Points | Payout |
|---|---|
| 5 | 1 to 1 |
| 6 | 3 to 1 |
| Four Card Flush | 5 to 1 |
| 7-8 | 7 to 1 |
| 9-10 | 10 to 1 |
| 11-12 | 15 to 1 |
| 13-14 | 25 to 1 |
| 20 | 100 to 1 |

Figure 11: Single Wager Nobs Payout

| Value | Payout |
|---|---|
| Nobs | 10 to 1 |

Figure 12: Single Wager Bonus Payouts

| Points | Payout |
|---|---|
| 4 Card Flush (in original 4 cards) | $35 |
| 5 Card Flush | $100 |
| 20-22 | $125 |
| 23-24 | $250 |
| Four 5's (in original 4 cards) | $1,500 |
| 28 | $2,500 (or 5% of pool) |
| 29 | $50,000 (or 100% of pool) |

METHOD OF PLAYING A CARD GAME AS A CASINO STYLE GAME, SLOT MACHINE OR VIDEO GAME

CROSS REFERENCE TO RELATED APPLICATION

This application is a Continuation in Part of pending U.S. patent application Ser. No. 11/150,454 filed Jun. 10, 2005 now abandoned entitled "Casino Cribbage Game Apparatus and Method". The Applicant hereby claims the benefit of the non-provisional application under 35 U.S.C. §120. The entire content of the non-provisional application is incorporated herein by this reference.

FIELD OF THE INVENTION

The present invention relates to a method of playing cards in the field of wagering card games as played in a casino with a house dealer, single or multiple players and established rules for playing and betting such game.

BACKGROUND OF THE INVENTION

Standard games like Blackjack and Poker are popular due to players' options and strategies for those games. There are many versions of Blackjack and Poker that are quite similar; however, those games have been created to be different in their betting strategies or designed with optional wagers and bonus payoffs in order to create new and exciting opportunities for players to wager on. Those games are all based off of the same standard deck of 52 cards and played with players and a separate dealer, yet each game uses those same cards differently and changes the rules in order to create a different element of risk. For example, in Blackjack, the standard practice can use anywhere from one to eight standard 52-card decks of cards; whereas, in Poker, there is generally the use of a single, standard 52-card deck of cards. Each game utilizes different techniques of wagering, cards can be dealt in special orders, and there can be multiple opportunities to wager. In its simplest form each game is unique to its play and outcome.

Players are always seeking new variations in casino style games to challenge them and bring excitement and entertainment into their leisure time. Each new game draws a particular group of players just as a new version of Blackjack will draw other Blackjack players more than it would draw Baccarat players. However, there are numerous games played with the standard 52-card deck of cards that are almost impossible, if not impossible, to become a casino style table game. These games, though popular, do not translate well into a casino style setting. Some of these games become patented; however, they do not make it to the casino because of challenges from the Gaming Commission, casino requirements, or lack of player support. Cribbage falls into the category as being difficult in creating the perfect casino style game because of its method of play; however, Applicant has found that elements of the game can be incorporated into versions of a playable casino style game.

The main problem in cribbage is in its math. For example, it can be calculated from 52 cards with 13 different valued cards the odds of receiving a pair when being dealt five cards. However, in some counting principles of cribbage using that same standard deck of 52 cards, how do you calculate six points when a five card hand can contain a variety of pairs, counts of 15, straights, flushes, and nobs?

There are nine separate combinations to create those same six points; therefore, it becomes extremely difficult to calculate the odds of almost 13 million different combinations of hands.

Today, creating a new game becomes a challenge. These variations need to make the games more interesting, exciting, and challenging. The game must capture the attention of players in order to become successful and considered a true casino style game. Three Card Poker and Caribbean Stud Poker are games that come to mind when it comes to variations of a standard game. There are many other patent protected games that draw on different numbers of cards dealt, multiple wagers, jackpot wagers, or techniques of dealer involvement. Reference to those and other related games are described in the U.S. patents summarized below:

VanderKley et al, U.S. Pat. No. 6,554,282 describes a modified game of cribbage played by betting the point score of each hand against a predetermined table of betting odds. In this form, the game may be played in a casino setting on a table provided with designated areas for the placement of a wager by each player, the placement of the dealt cards to each betting player and the placement of the cards dealt into the crib. Players are dealt five or six cards and players must discard one or two cards respectively. Players play against the dealer only and the odds payout according to statistical evaluation is: (points, payout) 0 (1:1), 1-7 (Dealer wins) 8 (Push), 9 to 11 (1:1), 12 to 14 (2:1), 15 to 17 (3:1), 18 to 20 (5:1). 21 to 23 (10:1), 24 (20:1), and 28 (250:1).

Foster et al, U.S. Pat. No. 6,824,137 describes a modified table version of cribbage using at least one deck of conventional playing cards, having at least one player making a wager and a dealer that deals the cards. A player makes a wager to receive a plurality of cards and the cards are dealt to each player and the dealer. The players discard either one or two cards depending on the method chosen. The dealer exposes his cards and discards two cards. The starter card is exposed, the players' cards are exposed and values of the hands are computed and compared to the dealer's hand to determine a winner. A crib hand may be created from the player discards and the dealer discards or a crib hand may be created from random cards. In addition, secondary and tertiary wagers (side wagers) may be made. Odds payoff can be made for an overall point total reached by the player. A 1 to 1 payoff can be made upon reaching a minimum value, and larger payoffs can be made for greater point values reached above the minimum. Sample Payoff Chart: 8 (1:1), 9 to 10 (3:1), 11 to 13 (5:1), 14 to 16 (10:1), 17 to 20 (25:1), 21 to 22 (50:1), 23 to 24 (100:1), 28 (500:1), 29 (1000:1) or Jackpot.

Cabot et al, U.S. Pat. No. 5,322,295 is a method of playing a multiple-hand Poker-like game that involves multiple betting. As each bet or wager is made a portion of the hand is dealt. Neal, U.S. Pat. No. 5,486,005 is a method and apparatus for playing a Poker-like game where after wagers are made an array of seven hands, each with four cards face-up are dealt by the dealer. A variety of final betting combinations are then selected by the players and three more cards are dealt face-up. The dealer then determines the winners and losers. Optional jackpot means are provided.

Jones, et al, U.S. Pat. No. 4,861,041 describes methods of progressive jackpot gaming in which either a live gaming table or a token accepting electro-mechanical apparatus is utilized. A cumulative jackpot is included and bettors win either all or a portion of this jackpot by having a hand containing a predetermined arrangement of cards.

Maleck, U.S. Pat. Nos. 5,265,882; 5,328,189; and 5,395,120 are multiple play games; where, U.S. Pat. No. 5,265,882 is a combination of three games in which each player plays at least two of the three games against the dealer and other players. U.S. Pat. No. 5,328,189 is where two games are combined and each player can play both games against the dealer and other players. And, U.S. Pat. No. 5,395,120 is where two games are mixed into a situation where each player bets and plays against other players and the house dealer.

Similarly, other variations in wagering structures can also increase the excitement and acceptance of such wagering games. Breeding, U.S. Pat. No. 5,417,430 discloses a Poker-like game with an altered wagering scheme thus allowing the player the opportunity to compete for an additional payout.

Other variations can be made to standard games to allow more player opportunity and involvement. Boylan et al, U.S. Pat. No. 5,098,107 discloses a game wherein additional symbols are added to increase wagering opportunities. This allows the player the opportunity to place several wagers on different portions of the game while the game is being played. Somewhat similarly, Holmberg, U.S. Pat. No. 3,667,757 discloses a board game wherein the player is given choices regarding alternative strategies for play; whereas, the different strategies chosen have different payoff results.

Many different wagering games presently exist for use in both home and casino environments. Such games should be exciting, uncomplicated and easy to learn. Card games and their varieties such as Poker and Blackjack have gained widespread popularity because of their established ranking of hands and well-known (although varied) rules. These games can involve continuous wagering opportunities for the players, thus increasing player participation and excitement. The games move quickly to maintain action and activity. Games like Blackjack and Poker are widely accepted and widely known because of these factors; however, a game such as cribbage does not necessarily fall under these same factors.

In order to fulfill the requirements of the casinos, its players, and any regulations over gaming and gaming tables, a new game has to distinctly claim and prove the unique aspects of it against any other games, patented or not, that are deemed well known. The uniqueness in any game from one to another is not necessarily in how the cards are dealt, or how much is wagered. The patented games listed above show this many times over. Instead, the uniqueness is in how the cards are valued and compared against similar hands or cards. An ace in Blackjack is treated differently than an ace in Poker. In Blackjack cards have point values whereas in Poker cards have rankings. Each game can use the same standard deck of 52 cards; however, the values of those cards contain a completely different interpretation.

The same is true for the present invention. Card values are completely different from that of Poker or Blackjack. A flush in Poker holds a completely different value (rank) than a flush in the game disclosed hereafter (points). The point value of Blackjack is from 2-21 points whereas in this game the point value is from 0-29 and is achieved in different manners (i.e. card suits have no value in standard Blackjack.) Overall, a uniqueness of the present invention is found in the statistical evaluation of how the odds are paid out and how the hands are valued at those odds. There is no casino style game where a player receives only four cards and counts point values based on the card counting principles as stated in this game. There are no instances of players being dealt only four cards, having no discards, and then all players wagering on the fifth common card based on the card counting principles as stated in this game. There are numerous instances of players dealing a plurality of cards and playing off an additional common card; however, those instances always include the requirement to discard one or more cards from the players and/or the dealer.

There are no instances where a player makes a primary wager, followed by a second wager following the first wager; with an instance of a third wager following a second wager to complete a single hand with the counting principles included with this game. There are instances of players making primary, secondary, and tertiary wagers; however, those are all made at the same instance and are for optional wagers being placed (i.e. a side bet.) The instance of primary, second and tertiary wagers in a tiered system is a required element of this invention and a primary unique element of this game and is required in determining the odds and opportunities for higher paying hands.

Foster et al, U.S. Pat. No. 6,824,137 and VanderKley et al, U.S. Pat. No. 6,554,282 are two patents that utilize similar counting principles; however, they do not have an opening hand requirement for the dealer at a minimum number of points. Instead, these patents are played comparing only the dealer's and players' hand. Due to the statistical limitations of those patents, payouts first start at eight points with a 1 to 1 payout and not four points as stated in this design, as will be described more fully hereafter. In addition, neither Foster nor VanderKley patents require the dealer to open at a predetermined value.

For Foster et al, U.S. Pat. No. 6,824,137 and VanderKley et al, U.S. Pat. No. 6,554,282, both patents require discarding one or two cards, with 91 instances of discarding cards in Foster and 7 instances of discarding cards in VanderKley. In both patents, those games are referred to as versions of cribbage because cribbage is a game (according to Hoyle's version) where a player is dealt five or six cards and discards one or two cards. Foster and VanderKley follow these rules as specified in their patents. Specifically, Applicant's game design is not cribbage nor should it be termed as cribbage as it does not follow the same standard rules of cribbage.

This invention's similarity to cribbage is only in some of its card counting principles; otherwise, there is no other relationship to cribbage. There is no pegging, there are no discarding of cards, there are no multiple hands of play, there is no crib built, there is no "his heels", there are no requirements in cutting for the deal, there is no swapping of the dealer, there is no requirement for two or more players, there is no 121 points to win, there is no play to 31 points, there are no laying of individual cards, and there is no playing against additional players. Many of the aforementioned instances can be found in either Foster or VanderKley.

The game of the present invention is unique, among other things, in the aspect where a player receives only four cards and does not discard any cards; the dealer receives only four cards and does not discard any cards; there is a three-tier wagering system with the players making additional decisions (wagers) on the same four card hand and then a five card hand; the requirement for the dealer to open; with a payout rate exclusive to the invention. The dealer is dealt four cards but never counts points in a four card hand. Also, dealers make no decisions on any hands. In Applicant's game, the Dealer's responsibility is only to ensure the rules of the game are followed, hands are properly counted, pay out winnings, and collect wagers. Applicant has determined this is what makes a true casino style game and that is the objective of the game Applicant has invented.

Additionally, the statistical data of four or five card opportunities is comprised of mathematical calculations based purely on one specific set of rules. If those rules were not followed, the data would not support the desired payouts. If this game were developed with the ability to have discards, then the mathematical calculations would have to be completely different. Foster et al, U.S. Pat. No. 6,824,137 and VanderKley et al, U.S. Pat. No. 6,554,282 have payouts which are derived from calculations based on being dealt five or six cards and discarding one or two cards. The calculations of those games are vastly different from the Applicant's game and are based on a single wagering opportunity (with the opportunity for secondary and tertiary wagers i.e. side-bets only) whereas this game is primarily based on a three-tiered wagering system required for the odds payouts based on the mathematical calculations of initially being dealt only four cards.

Games such as Brit-Brag (or Three Card Poker) Webb, U.S. Pat. No. 5,685,774 and Play 4 Poker (or Four Card Poker) Kenny et al, U.S. Pat. No. 7,195,243, need to be compared against other poker style patents for differences just as it is important to compare this game against Foster et al, U.S. Pat. No. 6,824,137 and VanderKley et al, U.S. Pat. No. 6,554,282 for differences as these patents utilize similar counting principles.

In more detail, VanderKley et al, U.S. Pat. No. 6,554,282 is a game based on the game of cribbage (Column 2, Lines 11-13) where the player is dealt five cards and discards two cards. The game disclosed herein does not play according to those specific rules. In VanderKley (Column 2, Line 13), two additional cards are used as common cards. The game created here uses only one common card. In VanderKley (Column 2, Line 16) players are awarded in accordance with a pay table that first starts at a value of nine (9) points. In this game, players are awarded starting at a value of four (4) points because of the difference in making the point combinations of a hand with only four cards and no discards. VanderKley (Column 2, Line 25) uses three of five cards (with 2 discarded) in combination with two exposed cards to determine the points. This game requires four cards with no discards and only one exposed (common) card to determine points. VanderKley uses a crib (Column 2, Line 33), and has double points for a five card flush (Column 2, Line 30); whereas, this game does not use a crib and does not give double the points for a five card flush.

In more detail, Foster et al, U.S. Pat. No. 6,824,137 is also a game based on the rules of cribbage (Column 2, Line 46.) In all figures except FIG. 8) players are required to discard cards. However, in FIG. 8) the player is making multiple hands out of the extra cards dealt which is a completely different game than what is proposed here. Also, in FIG. 8) the objective of that game is to have more winning hands than the dealer; again, no similarity to this game. Foster (Column 8, Line 37 and Line 42) states that this is a two, double or multiple game hand. Foster (Column 8, Line 43) states that hands can contain less than four cards whereas this game requires all four cards. Foster (Column 8, Line 38) states that only a single wager is made whereas this game requires a three-tier wagering system in order to complete the game.

In Foster (Column 7, Line 58) an embodiment with no discards is the result of creating a crib hand which this game does not create. In Foster, players still receive six cards (Column 7, Line 57) and still discard two cards (Column 7, Line 29) (as FIG. 5*c*) works according to FIG. 5*a*).) In one embodiment, claim 16 (Column 22, Lines 31-34) states there are three wagers where in the primary wager the player must exceed the dealer's hand (Column 22, Lines 50-53), the secondary wager where the player must exceed a predetermined value (Column 22, Line 54-57), and the tertiary wager where the crib must exceed a predetermined value (Column 22, Lines 58-60). Foster's wagering system is not the same as the three tiered wagering system in this game as Foster's wagers are made at the same time while playing three games with one or two hands of cards; whereas, in this game the three wagers are built upon one another in steps to create one single game.

In Foster (Column 9, Lines 20-30) players are awarded in accordance with a pay table that first starts at a value of eight (8) points. In this game, players are awarded starting at a value of four (4) points because of the difference in making the point combinations of a hand starting with only four cards and no discards. There are also no requirements for the dealer to "open" in any instances of the Foster patent. In Foster, dealers must make decisions based on hands dealt to themselves and thus cannot help any players with their hands.

Applicant has determined, by looking at all logic tables toward Foster versus the game disclosed here, that there is no similarity in how the games are played. Looking at all payouts for various instances of Foster there are none that match any of this game. This is because of the differences in how the cards are played in Applicant's invention via three-tier wagering, dealing only four cards, and having no discards. The odds of having zero points in four cards is approximately 26.9% whereas the odds of having zero points in five cards is less than 7.8% and zero points in six cards is even less. The more cards a player can receive, the higher his/her odds of achieving a higher scoring hand. Foster's requirement for discards are necessary as the odds of play are drastically changed if players are allowed to keep all five (or six) cards without discarding and then playing with the best hand out of all six (or seven) cards as seen in Kenny, U.S. Pat. No. 7,195,243 Play Four Poker. The ability to discard cards which don't add points to a hand is a major advantage for both players and dealer. Being dealt only four cards creates a unique situation where the player must make a decision to stay and wager or fold. Plus, the requirement of no discards and only working with the player's original four cards has greater appeal to strategy and play in general.

Another unique feature of this game is in the strategy of the three tier wagering system included with the counting principles of this game. A player with zero points in his/her four card hand is generally recommended to fold in order to reduce losses, yet there are some hands that merit staying to see the cut card. A player with four points in his/her five card hand with (for example) a ten showing as the cut card is recommended to stay; whereas that same hand with a five showing as the cut card is recommended to fold. By looking at the cut card, a player must make decisions depending upon what the cut card shows and can greatly influence a player's decision. With the cut card showing an ace vs. a King vs. a five, all cards have different strategies for the player as the odds for the dealer's hand changes with each possible card. The use of the cut card greatly affects both the player and dealer's hand, yet only the player makes any decisions.

Some players play games based on the house advantage or what the best odds payoffs are. By looking at the house advantage for numerous games, Applicant's game fits perfectly in the mix of well known games and gives better odds for players vs. some very popular games:

| Game | House Advantage |
|---|---|
| Blackjack | 0.51% |
| Pai Gao Poker | 1.46% |
| Three Card Poker (PairPlus) | 2.32% |
| Baccarat | 2.41% |
| The game of this Application | 2.64% |
| Three Card Poker (Ante) | 3.37% |

-continued

| Game | House Advantage |
|---|---|
| Let It Ride | 3.51% |
| Caribbean Poker | 5.22% |
| Roulette | 5.26% |

Other players compare games side by side, looking for an advantage of one game over another. In Caribbean Stud Poker the odds of receiving a pair or better is 50.001 percent; whereas, the odds of receiving four points or more in this application is 61.501 percent. This creates more opportunities for the player to play an opening hand and it allows for the dealer to open more often; thus creating far more player involvement.

Another comparison that can be shown against Caribbean Stud Poker is in the odds payout for when the dealer opens or doesn't open. A key feature of the game disclosed in this application is that even if the dealer does not open, the dealer pays odds on high valued hands. In Caribbean Stud Poker, the dealer pays odds on such hands only if the dealer opens. When the dealer does not open (approximately 50 percent of the time) players with high valued hands are left disappointed as they don't receive any additional payout. Comparison of this application to Foster or VanderKley is not applicable as they don't require the dealer to open.

In summary, what players and casinos are looking for is a game that is fun, easy to play, uncomplicated to understand, provides an entertaining opportunity for risk, and can be won. It therefore is an objective of this invention to provide a game that fulfills all these requirements and more. In addition, the game of this invention eliminates any decision making by dealers thus allowing the dealer to assist players, as the dealer's responsibility is only to properly count hands and make payouts or take in wagers according to the rules of the game. Provided with a greater amount of participation and additional winning opportunities, the game of the present invention becomes very attractive and enjoyable, not only to players, but to casinos as well.

Definitions

As used in the present patent application, the following words have the following meanings described to them:

"Ace"—One. The lowest card value in the deck of 13 different values of a standard deck of 52 cards. In said game an ace is not considered high as in poker and is not considered in a straight with face cards.

"Ante"—The initial contribution that each player makes to begin a game.

"Bet"—The third wager in a three-tiered wagering system or the second wager in a two-tiered wagering system. The amount wagered is generally equal to the previous wager (if made.)

"Cut"—The second wager made in a three-tiered wagering system. The amount wagered is generally equal to the previous wager (if made.) Cut may also be used to refer to the position on the game board where cut wagers are placed.

"Cut Card"—The fifth card that is playable by all players.

"Dealer"—Controls the game and is responsible for the proper counting of hands, proper payouts, and taking in of monies. The dealer can also be referred to as the "banker."

"First Four"—Refers to a player's first four cards dealt.

"Fold"—To drop from the game.

"Fifteen"—Any combination of two to five cards totaling a count of 15. Each 15 combination is worth two points toward the total count of a player's hand.

"Flush"—Any five cards of the same suit. In said game a four card flush can be made where there are any four cards of the same suit not including the cut card. Four card flushes are worth four points where five card flushes are worth five points toward the total count of a player's hand.

"Hand"—A player's four cards with or without the fifth (cut) card.

"Jack"—Valued in a deck of cards as the $11^{th}$ highest in rank according to a standard of 13 different values. Ranking has no value in said game; however, jacks are required in determining Nobs.

"King"—Valued in a deck of cards as the highest card value in rank according to a standard of 13 different values. Ranking has no value in said game.

"Nobs"—A jack in the four card hand has the same suit as the fifth (cut) card. Counts as one point toward a player's hand. May also be expressed as "His/her nobs" or "Right Jack."

"Open"—A conditional situation where the dealer must have a predetermined number of points or value of cards in the dealer's five card hand in order for all options of the game to come into play.

"Pair"—Two cards of the same face or number value. Counts as two points toward a player's hand.

"Player"—Any person who at a minimum ante's and is still in the game.

"Push"—A condition where there is no payout toward or taking in of wagers. A negated condition where there is no winner or loser.

"Standard Deck of Cards"—consists of 52 cards containing four different suits and 13 different point values for each suit.

"Straight"—Any combination of three, four, or five cards in sequential order and of any suit. Combinations for straights start from five card and work down. (i.e. you cannot make combinations of two three-card straights out of a four card straight.) Counts as one point for each card in said straight combinations toward a player's hand.

"Twenty Nine"—Highest number of points possible in said game. Considered a perfect hand.

"Zero"—When indicating no points in hand. May also be expressed as nineteen, none, nothing, or nada.

SUMMARY OF THE INVENTION

Accordingly, the game method of the present invention, according to one embodiment, includes a game board with areas for placing first wagers and then second wagers. At least one player and at least one dealer are dealt several cards from one deck of 52 cards and where, with no cards discarded, at least one player makes a first wager and a common last card is disclosed and where at least one player makes a second wager before at least one player's hand and the dealer's hand are compared so as to determine a winning hand.

In yet another embodiment of the invention, the game includes a game board with areas for placing first wagers, then second wagers, and then third wagers. After a first wager by at least one player, at least one player and at least one dealer are dealt several cards from one deck of 52 cards and where, with no cards discarded, at least one player places a second wager and a common last card is disclosed and where at least one player places a third wager before at least one player's hand and the dealer's hand are compared so as to determine a winning hand. According to another aspect, the game board is a simulated game board displayed on a mechanical or electronic game device. In another aspect, the dealer must have at least a predetermined minimum of points in order for the game to open. In a further aspect, the dealer must have at least a minimum of four points in order for the game to open.

In accordance with another aspect of the invention, additional wagers can be placed before the cards are dealt. In another aspect of the invention, additional wagers can be placed after the cards are dealt. According to another aspect of this invention, the game board is a simulated game board displayed on a mechanical, electronic or video game device.

In yet another embodiment of the invention, a wager can be selected where the common last card suit matches the suit of a jack in the player's hand. In yet another embodiment of the invention, the player wagers on a four card hand where said hand needs to contain enough points necessary to win on a separate payout chart. In yet another embodiment of the invention, a wager can be selected where the player's five card hand will contain enough points necessary to win on a separate payout chart paying odds on both four and five card opportunities.

The method of playing this game as described in embodiments as listed above is given in more detail hereafter. The scoring method of this game for both four and five card hands will be in accordance with the counting principles as stated below:

(a.) Counts of 15 (fifteen), where:
- a. two to five cards are combined in value to total 15. Each combination of 15 counts as 2 (two) points toward a hand's total score.
- b. there is no provision for a single card to value a count of 15.
- c. the card's suit has no value when looking for combinations of 15.

(b.) Pairs:
- a. Where two cards are of the same value. Jacks, queens, and kings pair only with other jacks, queens, and kings respectively. For example, jacks do not pair with queens. Each combination of pairs counts as 2 (two) points toward a hand's total score.
- b. Where three cards are of the same value (three of a kind), it constitutes three separate pair combinations for a total of 6 (six) points.
- c. Where four cards are of the same value (four of a kind), it constitutes six separate pair combinations for a total of 12 (twelve) points.

(c.) Straights, where there are three forms of straights; five card, four card, and three card straights. Straights are derived from the highest number straight to the lowest number straight where a five card straight is counted as one five card straight and not as two sets of four card straights.
- a. A five card straight has only one possible 5-card combination for a count of 5 (five) points (or 1 point for each card in the straight) toward a hand's total score.
- b. Four card straights have two possible 4-card combinations where each 4-card combination is worth 4 (four) points (or 1 point for each card in the straight) toward a hand's total score.
- c. Three card straights have three possible 3-card combinations where each 3-card combination is worth 3 (three) points (or 1 point for each card in the straight) toward a hand's total score.

(d.) Flushes, where there are two forms of flushes; a first four card flush and a five card flush. Flushes are four or five cards of the same suit not necessarily in sequence. The requirement is that the four card flush can only happen in the first four cards dealt to a player or dealer. The fifth card flush can follow for an extra point.
- a. A four card flush will consist of the first four cards dealt to the player with the same suit, but not necessarily in sequence. The four card flush will be worth 4 (four) points toward a hand's total score.
- b. A Five card flush will follow a four card flush if the fifth card's suit matches those of the four card flush and will add 1 (one) additional point toward a hand's total score.

(e.) Nobs, where a jack in the individual hand is of the same suit as the cut card. Nobs counts for 1 (one) point toward a hand's total score.

BRIEF DESCRIPTION OF THE DRAWINGS

Other objects, features and advantages of the present invention will become more fully apparent from the following detailed description of the preferred embodiment, the appended claims and the accompanying drawings in which:

FIG. 8 shows a table with possible payouts according to embodiments of the three-tier system.

FIG. 9 shows a table with possible payouts according to embodiments of the two-tier system.

FIG. 10 shows a table with possible payouts according to embodiments of the single wager "First Four" system.

FIG. 11 shows a table with a possible payout according to embodiments of the single wager "Nobs" system.

FIG. 12 shows a table with possible payouts according to embodiments of the single wager "Bonus" system.

DETAILED DESCRIPTION OF THE INVENTION

Figure 1:
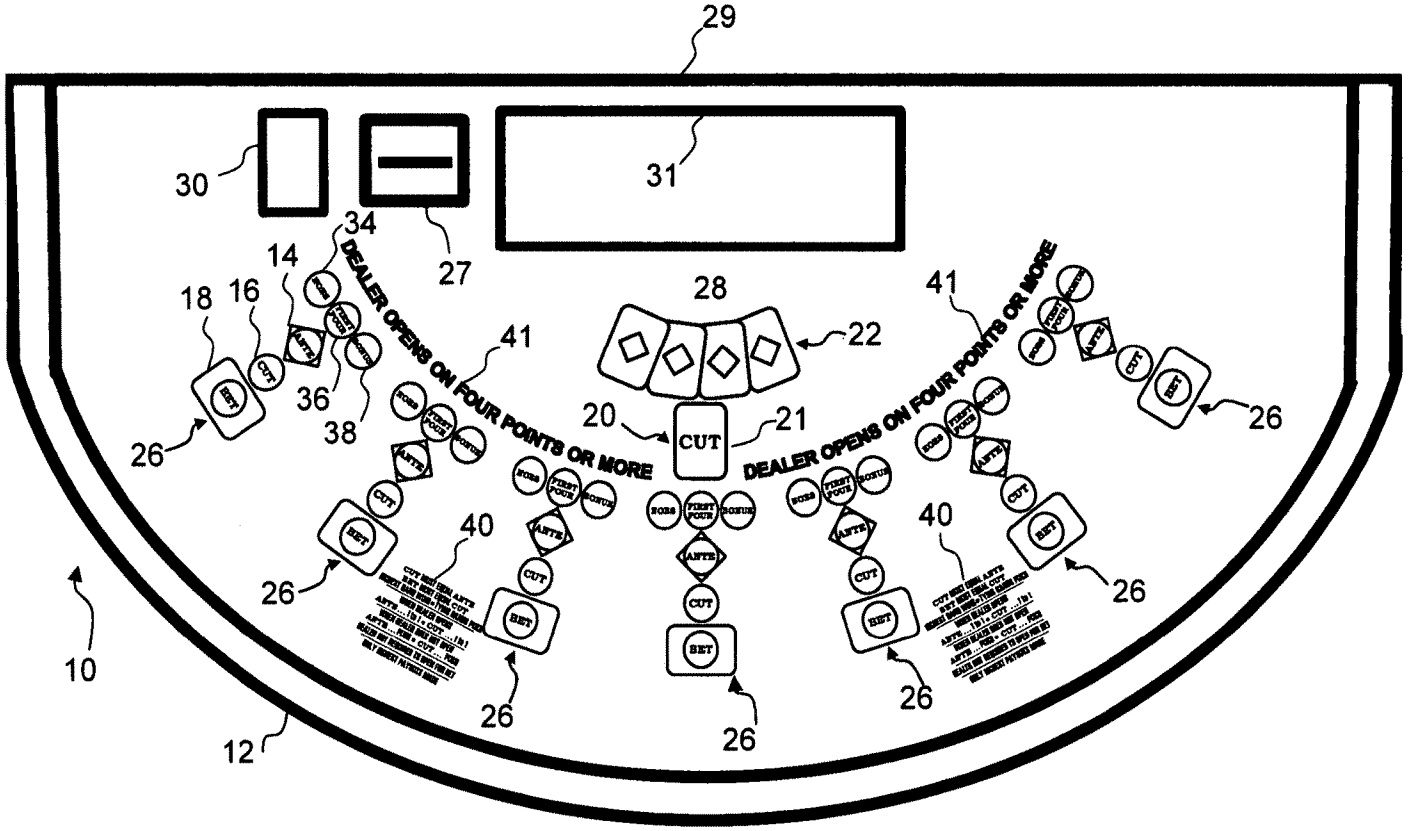
FIG. 1 is a top view of the casino style game apparatus according to an embodiment of the invention showing a table layout.

The preferred embodiment of the present invention is illustrated by way of example in FIGS. 1 through 12. With specific reference to FIGS. 1 and 2, the game (10) of the present invention includes a game board (12). Game board (12), according to one embodiment, includes an area (14) for players to place a first wager and an area (16) for placing a second wager. According to another embodiment, game board (12) includes an area (18) for placing a third wager, all as will be more fully disclosed hereafter.

FIG. 1 shows that game board (12) has places for seven separate players (players not shown). Each place for a player preferably is identical to the other places on a particular game board (12) for consistency and to prevent confusion. Obviously, game board (12) may contain any number of player positions now known or hereafter developed and desired.

FIG. 1 also shows an area (20) for the placement of a common last card, and area (22) for the placement of the dealer's cards. FIG. 1 also shows area (28) located in front of a dealer location (29) (dealer not shown) upon which a dealer may shuffle cards. Area (27) shows the general location of a money drop drawer, area (30) shows the general location for collected cards and area (31) shows the general location of a chip tray. Area (40) is a general location for selected rules to be displayed and area (41) shows the requirements for the dealer to open. Areas (34), (36), and (38) are for additional embodiments of the game of the present invention as will be described more fully hereafter. Cards used are a normal/standard deck of 52 cards divided into the usual four suits of thirteen cards each. The normal deck of cards are used so as to allow for the application of the normal rules of the game, as those of ordinary skill in the art should be aware of and familiar with, in determining the value of a hand. Certainly, other types of cards with other numbers and/or pictures may be used so long as the general rules of the game as set forth herein are applied.

Figure 2:
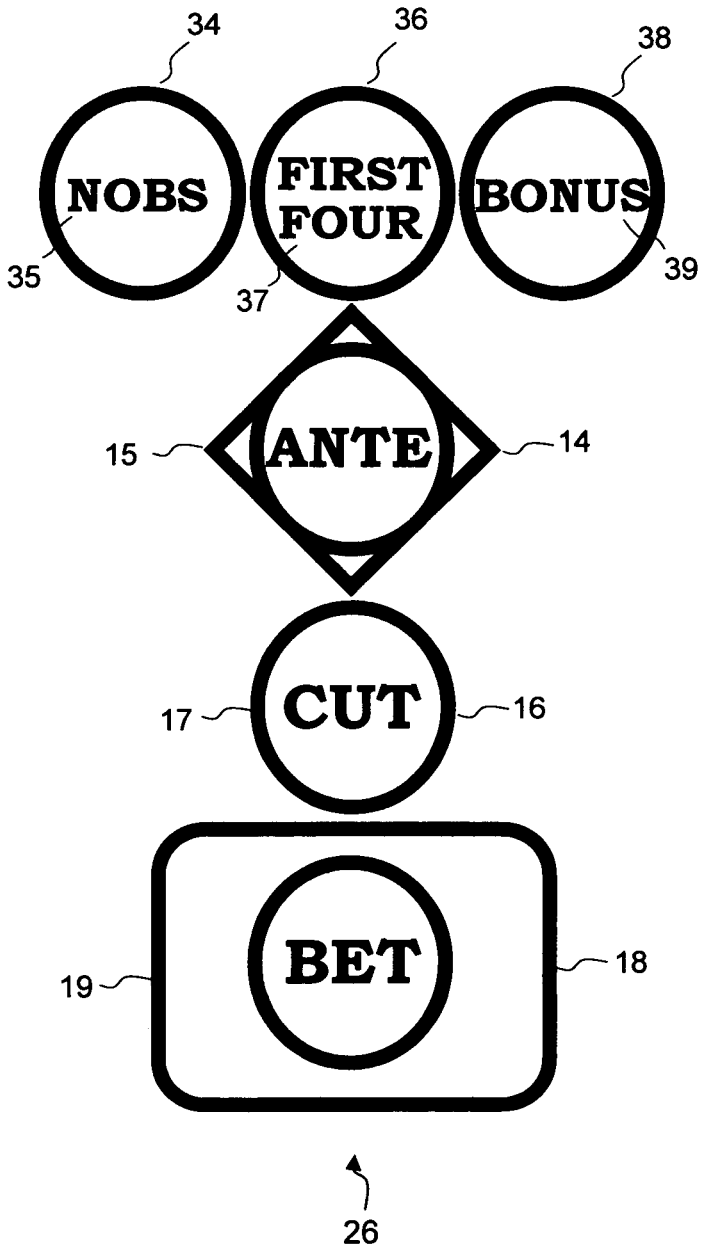
FIG. 2 is an illustration of a basic layout of the invention of FIG. 1, showing the per player layout for wagers.

Referring now to FIG. 2, a preferred embodiment of the layout for a single player's location or position at game board (12), as shown in FIG. 1, is illustrated. As shown in FIG. 2, the first wager area (14), second wager area (16), and third wager area (18) are aligned in front of the player with the third wager area (18) closest to the player (player not shown). The player faces the dealer location (29), as shown in FIG. 1, and according to one embodiment, places a first wager or "ante" (15) in the first wager area (14) in order to participate in the hand. All the players that make a first wager are then dealt several cards face down. According to a preferred embodiment, four cards are dealt to each player making a first wager and four cards are dealt to the dealer. Importantly, according to Applicant's invention, there are no discards as occurs in other games, patented or not, known in the art. Here, the player determines whether his/her initial four cards, again preferably, merits continuing with the game or not. If the player folds, he/she loses his/her "ante" (15) or first wager and the game for that player is over. If the player continues with the game, the player must then make a second wager, called the "cut" (17) in area (16), in order to see an additional common last card (21) of FIG. 1, (called the cut card) which will be then placed face up in area (20) of FIG. 1. In a preferred four card deal, the common last card (21) of FIG. 1 is the fifth card and is used by all remaining players and the dealer. Once the cut card is revealed, the player must determine whether his/her now five card hand merits continuing or not. If the player decides to fold, the player loses his/her first wager, the "ante" (15), and the second wager, the "cut" (17).

If the player decides to continue, the player then makes a third wager, called the "bet" (19). After all the players place his/her wager, the dealer exposes the dealer's four cards face up in area (22) of FIG. 1, in front of the dealer location (29) of FIG. 1, to all the remaining players still in the hand. The dealer then determines the point value in the dealer's hand, including the cut card (21) of FIG. 1, in area (20) of FIG. 1 based on the counting rules described in the summary of this invention. If the dealer's hand contains more points than a player's hand, the player loses the first wager, "ante" (15), the second wager, "cut" (17), and the third wager, "bet" (19). If the dealer's hand contains fewer points than the player's hand, the dealer pays the player the "ante" (15), the "cut" (17), and the "bet" (19) where the "bet" pays out odds in accordance with the three tier wagering table found in FIG. 8. If there is a draw, there is no payout or collection of the "ante" (15), "cut" (17), and/or "bet" (19). Players are playing against the dealer's hand only and not against other players.

According to one embodiment, the dealer's hand must be worth a predetermined minimum in order to "open" or continue the hand. According to one embodiment, the dealer must have at least four points or more, according to the counting rules described in the summary of this game system, for the game to be considered open. In this embodiment, if the dealer's hand, including the last common card (21) of FIG. 1, does not have at least four points, the dealer does not open, and the dealer does not pay on any "ante" (15) or "cut" (17) wagers. However, any player that has four or more points will win the third wager, "bet" (19), and be paid according to the counting rules described in the summary of this system. In the case where a player places a wager on "bet" (19) with less than four points and the dealer does not open, the wager on "bet" (19) is considered a push and there is no pay out or collection.

After all payouts and collections have been completed, the game is over, the cards are gathered and reshuffled, and then a new game can begin.

Obviously, any predetermined "opening amount" may be selected. Opening with four points is a preferred embodiment; however, for example, three or five points may be required. Other options, for example, requiring a minimum of two "15's", two pair, or a run of three, (per stated counting rules described in the summary of this system) may be required as understood in this game system. Determining the open by different points or combinations Applicant has determined had a dramatic and unexpected effect on the odds and payouts of the game.

Figure 3:
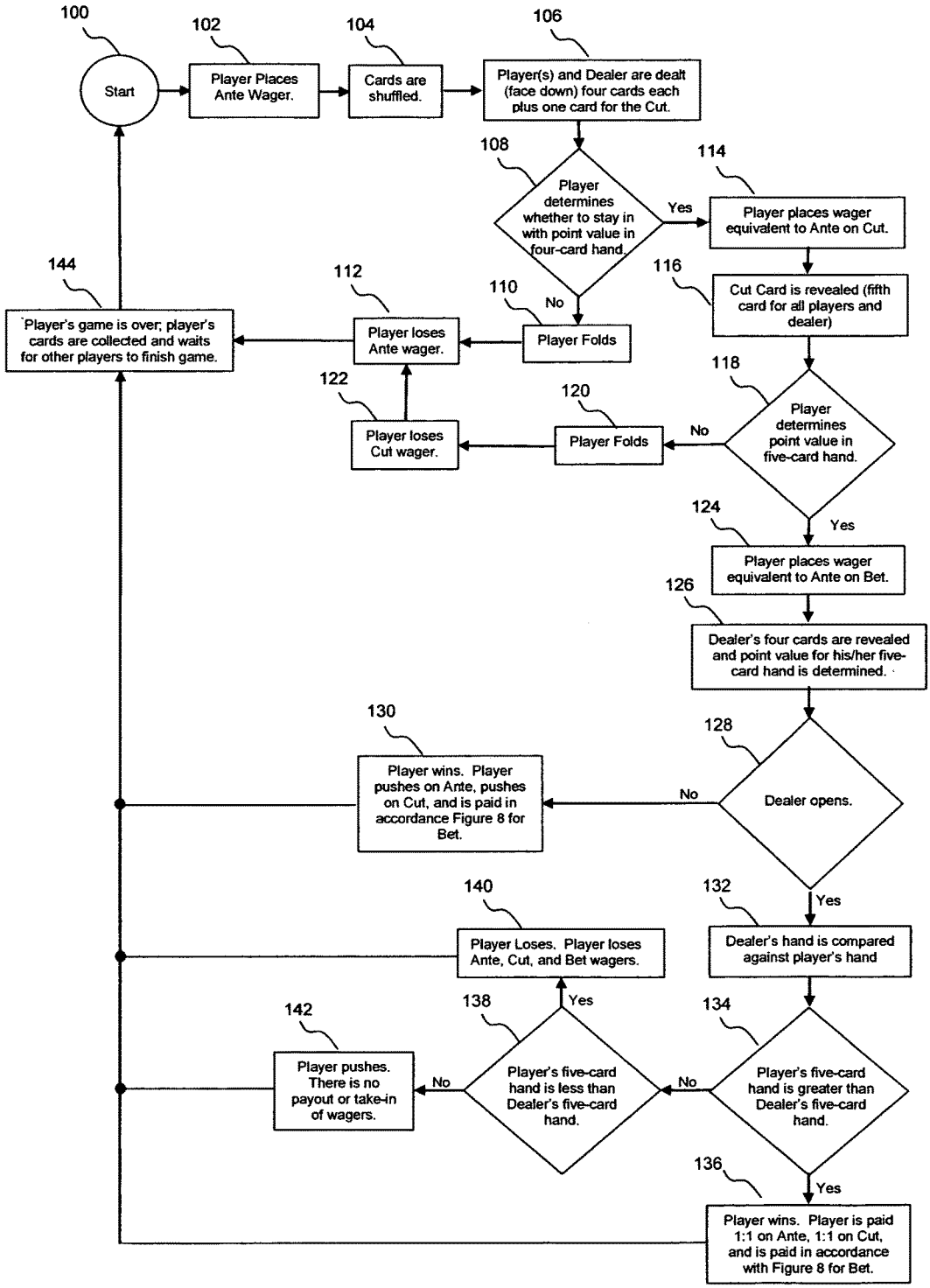
FIG. 3 is a logic table illustrating the logic flow for a three-tier wagering system.

FIG. 3 is a flow chart representation of the game according to the present system where there is a three-tier wagering system. The game starts at act 100 indicating a new game. At act 102, the player places an "ante" wager indicating that the player is in the game. The cards are shuffled at act 104 and four cards are dealt (face down) to each player and dealer with one card being dealt (face down) to the "cut" location at act 106. At act 108, the player makes a decision as to whether his/her hand is worth continuing on with and can either wager to see the "cut" card or fold. If the player desires to fold, at act 110, the player will fold, the dealer will collect the "ante" wager at act 112 and the player's cards will be collected and the game will be over until all other players have played out their hands at act 144.

If the player decides that his/her hand has sufficient value as to continue, the player will place a wager on the "cut" equal to the "ante" wager at act 114. The "cut card" will then be revealed at act 116 where that card will now be represented in, or "included" in, all players' hands and the dealer's hand for a five card hand. At act 118 the player must now make a decision as to whether his/her hand is worth continuing on with and can either wager on the "bet" or fold. If the player desires to fold, at act 120, the player will fold; the dealer will collect the "cut" wager at act 122 and collect the "ante" wager at act 112. The player's cards will be collected and the game will be over until all other players have played out their hands at act 144.

If the player decides that his/her hand has sufficient value as to continue, the player will place a wager on the "bet" equal to the "cut" wager at act 124. At act 126 the dealer will reveal his/her four cards and with the "cut card" determine the value of his/her five card hand. At act 128 if the dealer's hand exceeds a predetermined value (generally four points) the dealer will have fulfilled the requirement to open. If the hand does not exceed the predetermined value, the dealer will not open. If the dealer does not open, the player wins at act 130. Because the dealer did not open, the "ante" wager is considered a push, the "cut" wager is considered a push, and the "bet" wager is paid out in accordance with the odds payout described in FIG. 8 for a three-tier system. At act 144 the game is over for the player, his/her cards are collected and the player will wait for all other players to finish their game.

At act 128, if the dealer's hand opens, the dealer's hand will be compared against the player's hand at act 132. At act 134, if the player's hand exceeds the point value of the dealer's hand, the player wins at act 136 and the player is paid 1 to 1 on the "ante" wager, 1 to 1 on the "cut" wager, and the player will be paid on the "bet" in accordance with the odds payout chart from FIG. 8 for a three-tier system. At act 144 the game is over for the player, his/her cards are collected and the player will wait for all other players to finish their game.

At act 128, if the dealer's hand opens, the dealer's hand will be compared against the player's hand at act 132. At act 134, if the player's hand does not exceed the point value of the dealer's hand, another decision has to be made. At act 138, if the dealer's hand exceeds the player's hand, then the player loses. At act 140, the dealer will collect the player's "ante", "cut", and "bet" wagers. At act 144 the game is over for the player, his/her cards are collected and the player will wait for all other players to finish their game.

At act 128, if the dealer's hand opens, the dealer's hand will be compared against the player's hand at act 132. At act 134, if the player's hand does not exceed the point value of the dealer's hand, another decision has to be made. At act 138, if the dealer's hand does not exceed the player's hand, then through the logic of acts 134 and 138 a push situation occurs. At act 142, when a push situation occurs, there is no pay out of winnings or taking in of wagers. At act 144 the game is over for the player, his/her cards are collected and the player will wait for all other players to finish their game. A new game then starts again at act 100.

In yet another embodiment of the invention with specific reference to FIGS. 1 and 2, the game (10) of the present invention includes the same game board (12). Game board (12), according to this embodiment, includes an area (14) for players to place a first wager and an area (18) for placing a second wager. The only difference in this embodiment is the removal of area (16) as there is only a two-tier wager as will be fully described and disclosed hereafter.

FIG. 1 shows that game board (12) has places for seven separate players (players not shown). Each place for a player preferably is identical to the other places on a particular game board (12) for consistency and to prevent confusion. Obviously, game board (12) may contain any number of player positions now known or hereafter developed and desired.

FIG. 1 also shows an area (20) for the placement of a common last card, and area (22) for the placement of the dealer's cards. FIG. 1 also shows area (28) located in front of a dealer location (29) (dealer not shown) upon which a dealer may shuffle cards. Area (30) shows the general location for collected cards and area (31) shows the general location of a chip tray. Area (40) is a general location for selected rules to be displayed and area (41) shows the requirements for the dealer to open. Areas (34), (36), and (38) are for additional embodiments of said system. Cards are a normal/standard deck of 52 cards divided into the usual four suits of thirteen cards each. The normal deck of cards are used so as to allow for the application of the normal rules of said game, as those of ordinary skill in the art should be aware of and familiar with, in determining the value of a hand. Certainly, other types of cards with other numbers and/or pictures may be used so long as the general rules of said game are applied.

Referring now to FIG. 2, a preferred embodiment of the layout for a single player's location or position at game board (12), as shown in FIG. 1, is illustrated. As shown in FIG. 2, the first wager area (14), second wager area (16), and third wager area (18) are aligned in front of the player with the third wager area (18) closest to the player (player not shown). For this embodiment the second wager area (16) is not utilized. The player faces the dealer location (29), as shown in FIG. 1, and according to this embodiment, places a first wager or "ante" (15) in the first wager area (14) in order to participate in the hand. All the players that make a first wager are then dealt several cards face down. According to a preferred embodiment, four cards are dealt to each player making a first wager and four cards are dealt to the dealer. Importantly, according to Applicant's invention, there are no discards as occurs in other patented games known in the art. Here, the player determines whether his/her initial four cards, again preferably, merits continuing with the game or not. If the player folds, he/she loses his/her "ante" (15) or first wager and the game for that player is over.

If the player continues with the game, the player must then make a second wager, called the "bet" (19) in area (18), in order to see an additional common last card (21) of FIG. 1, (called the cut card) which will be placed face up in area (20) of FIG. 1. In a preferred four card deal, the common last card (21) of FIG. 1 is the fifth card and is used by all remaining players and the dealer. Once the cut card is revealed, the dealer exposes the dealer's four cards face up in area (22) of FIG. 1, in front of the dealer location (29) of FIG. 1, to all the remaining players still in the hand. The dealer then determines the point value in the dealer's hand, including the cut card (21) of FIG. 1, in area (20) of FIG. 1 based on the counting rules described in the summary of this system. If the dealer's hand contains more points than a player's hand, the player loses the first wager, "ante" (15) and the second wager, "bet" (19). If the dealer's hand contains fewer points than the player's hand, the dealer pays the player the "ante" (15) and the "bet" (19) where the "bet" pays out odds in accordance with the two-tier wagering table found in FIG. 9. If there is a draw, there is no payout or collection of the "ante" (15) and/or "bet" (19). Players are playing against the dealer's hand only and not against other players.

According to one embodiment, the dealer's hand must be worth a predetermined minimum in order to "open" or continue the hand. According to one embodiment, the dealer must have at least four points or more, according to the counting rules described in the summary of this system, for the game to be considered "open". According to one embodiment, if the dealer's hand, including the last common card (21) of FIG. 1, does not have at least four points, the dealer does not open, and the dealer does not pay on any "ante" (15) wagers. However, any player that has four or more points will win the second wager, "bet" (19), and be paid according to the counting rules described in the summary of this system. In the case where a player places a wager on "bet" (19) with less than four points and the dealer does not open, the wager on "bet" (19) will be considered a push and there will be no pay out or collection.

After all payouts and collections have been completed, the game is over, the cards are reshuffled and a new game can begin.

Obviously, any predetermined "opening amount" may be selected. Opening with four points is a preferred embodiment; however, for example, three or five points may be required. Other options, for example, requiring a minimum of two counts of 15, two pair, or a run of three (per stated counting rules described in the summary of this system) may be possible "open" opportunities as understood in this system. Determining the open by different points or combinations may have a dramatic effect on the odds and payouts of the game.

Figure 4:
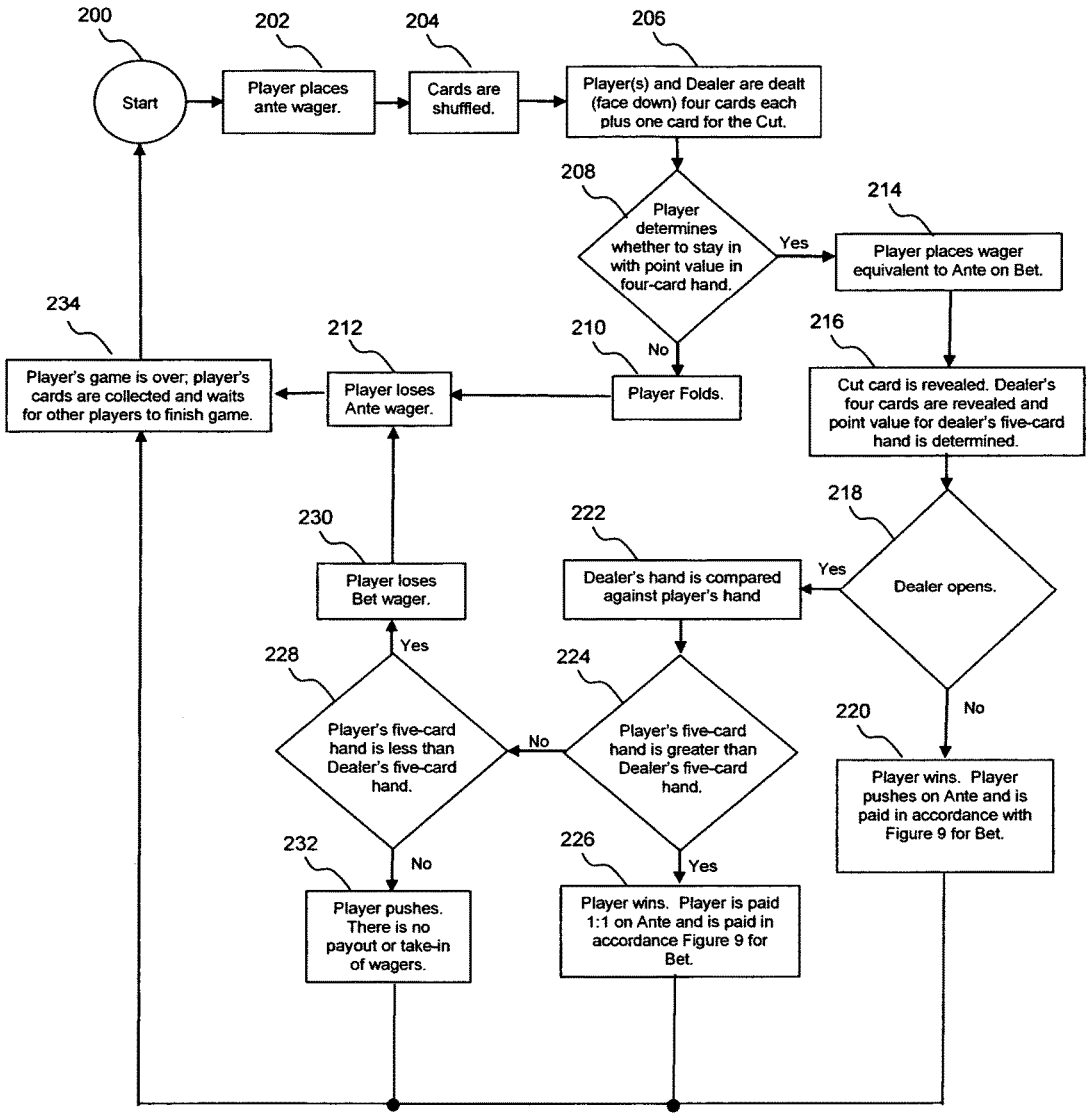
FIG. 4 is a logic table illustrating the logic flow for a two-tier wagering system.

FIG. 4 is a flow chart representation of the above embodiment of the game according to the present system where there is a two-tier wagering system. The game starts at act 200 indicating a new game. At act 202, the player places an "ante" wager indicating that the player is in the game. The cards are shuffled at act 204 and four cards are dealt (face down) to each player and dealer with one card being dealt (face down) to the "cut" at act 206. At act 208, the player makes a decision as to whether his/her hand is worth continuing on with and can either wager on the "cut card" or fold. If the player desires to fold, at act 210, the player will fold, the dealer will collect the ante wager at act 212 and the player's cards will be collected and the game will be over until all other players have played out their hands at act 234.

If the player decides that his/her hand has sufficient value as to continue, the player will place a wager on the "bet" equal to, one-half, or twice the "ante" wager at act 214. The "cut card" will then be revealed at act 216 where that card will now be represented in all player's hands and the dealer's hand to form a five card hand. At act 216 the dealer will then reveal his/her four cards and with the "cut card" determine the value of his/her five card hand. At act 218 if the dealer's hand exceeds a predetermined value (generally four points) the dealer will have fulfilled the requirement to open. If the hand does not exceed the predetermined value, the dealer will not open. If the dealer does not open, the player wins at act 220. Because the dealer did not open, the "ante" wager is considered a push and the "bet" wager is paid out in accordance with the odds payout chart disclosed in FIG. 9 for a two-tier system. At act 134 the game is over for the player, his/her cards are collected and the player will wait for all other players to finish their game.

At act 218, if the dealer's hand opens, the dealer's hand will be compared against the player's hand at act 222. At act 224, if the player's hand exceeds the point value of the dealer's hand, the player wins at act 226 and the player is paid 1 to 1 on the "ante" wager and the player will be paid for the "bet" wager in accordance with the odds payout chart disclosed in FIG. 9 for a two-tier game. At act 234 the game is over for the player, his/her cards are collected and the player will wait for all other players to finish their game.

At act 218, if the dealer's hand opens, the dealer's hand will be compared against the player's hand at act 222. At act 224, if the player's hand does not exceed the point value of the dealer's hand, another decision has to be made. At act 228, if the dealer's hand exceeds the player's hand, then the player loses. At act 230, the dealer will collect the player's "bet" wager and at act 212 the dealer will collect the player's "ante" wager. At act 234 the game is over for the player, his/her cards are collected and the player will wait for all other players to finish their game.

At act 218, if the dealer's hand opens, the dealer's hand will be compared against the player's hand at act 222. At act 224, if the player's hand does not exceed the point value of the dealer's hand, another decision has to be made. At act 228, if the dealer's hand does not exceed the player's hand, then through the logic of acts 224 and 228 a push situation occurs. At act 232, when a push situation occurs, there is no pay out of winnings or taking in of wagers. At act 234 the game is over for the player, his/her cards are collected and the player will wait for all other players to finish their game. A new game then starts again at act 200.

In another embodiment of the Applicant's game (10) does not require an "ante" (15) prior to receiving a hand dealt from the dealer. In such a case, the "cut" (17) is actually the first wager made by a player and the "bet" (19) is the second wager. Thereafter the game is played as described above.

In yet another embodiment of the system with specific reference to FIGS. 1 and 2, the game (10) of the present invention includes the same game board (12). Game board (12), according to this embodiment, includes an area (36) for players to place a first wager as will be fully described and disclosed hereafter.

FIG. 1 shows that game board (12) has places for seven separate players (players not shown). Each place for a player preferably is identical to the other places on a particular game board (12) for consistency and to prevent confusion. Obviously, game board (12) may contain any number of player positions now known or hereafter developed and desired.

FIG. 1 also shows an area (20) for the placement of a common last card, and area (22) for the placement of the dealer's cards. FIG. 1 also shows area (28) located in front of a dealer location (29) (dealer not shown) upon which a dealer may shuffle cards. Area (30) shows the general location for collected cards and area (31) shows the general location of a chip tray. Area (40) is a general location for selected rules to be displayed and area (41) shows the requirements for the dealer to open. Areas (34) and (38) are for additional embodiments of said system. Cards are a normal/standard deck of 52 cards divided into the usual four suits of thirteen cards each. The normal deck of cards are used so as to allow for the application of the normal rules of said game, as those of ordinary skill in the art should be aware of and familiar with, in determining the value of a hand. Certainly, other types of cards with other numbers and/or pictures may be used in the game and the general rules of said game are applied.

Referring now to FIG. 2, a preferred embodiment of the layout for a single player's location or position at game board (12), as shown in FIG. 1, is illustrated. As shown in FIG. 2, the first wager area (14), second wager area (16), and third wager area (18) may or may not be utilized. In this embodiment, only area (36) will be utilized. The player faces the dealer location (29), as shown in FIG. 1, and according to this embodiment, places a first wager on the "First Four" (37) in the first wager area (36) in order to participate in the hand. All the players that make a first wager are then dealt several cards face down. According to a preferred embodiment, four cards are dealt (face down) to each player making a first wager and four cards are dealt (face down) to the dealer with one card dealt (face down) in area (20) of FIG. 1. Here, the player determines whether his/her initial four cards, again preferably, merits continuing with the game or not. If the player folds, he/she loses his/her "First Four" (37) or first wager and the game for that player is over.

If the player continues with the game, an optional step of where an additional common last card (21) of FIG. 1, (called the "cut card") will be placed face up in area (20) of FIG. 1. In a preferred four card deal, the common last card (21) of FIG. 1 is the fifth card and is used by only the dealer in this embodiment. Once the "cut card" is revealed (optional), the dealer exposes the dealer's four cards face up (optional) in area (22) of FIG. 1, in front of the dealer location (29) of FIG. 1, to all the remaining players still in the hand. The dealer then determines the point value in the dealer's five card hand, including the "cut card" (21) of FIG. 1, in area (20) of FIG. 1 based on the counting rules described in the summary of this system. If the player's hand contains fewer points than what is determined in a single wager game in FIG. 10, the player loses the wager, "First Four" (37). If the player's hand contains the same or more points than what is determined in a single wager game according to FIG. 10, the dealer pays the player the "First Four" (37) where the game pays out odds in accordance with the single wagering table found in FIG. 10. There are no draw situations in this embodiment. Players are playing for payouts from FIG. 10 only and not against the dealer's hand or against any other players.

According to one embodiment, the dealer's hand must be worth a predetermined minimum in order to "open" or continue the hand. According to one embodiment, the dealer must have at least four points or more, according to the counting rules described in the summary of this system, for the game to be considered open. According to one embodiment, if the dealer's hand, including the last common card (21) of FIG. 1, does not have at least four points, the dealer does not open.

After all payouts and collections have been completed, the game is over, the cards are reshuffled and a new game is begun.

Figure 5:
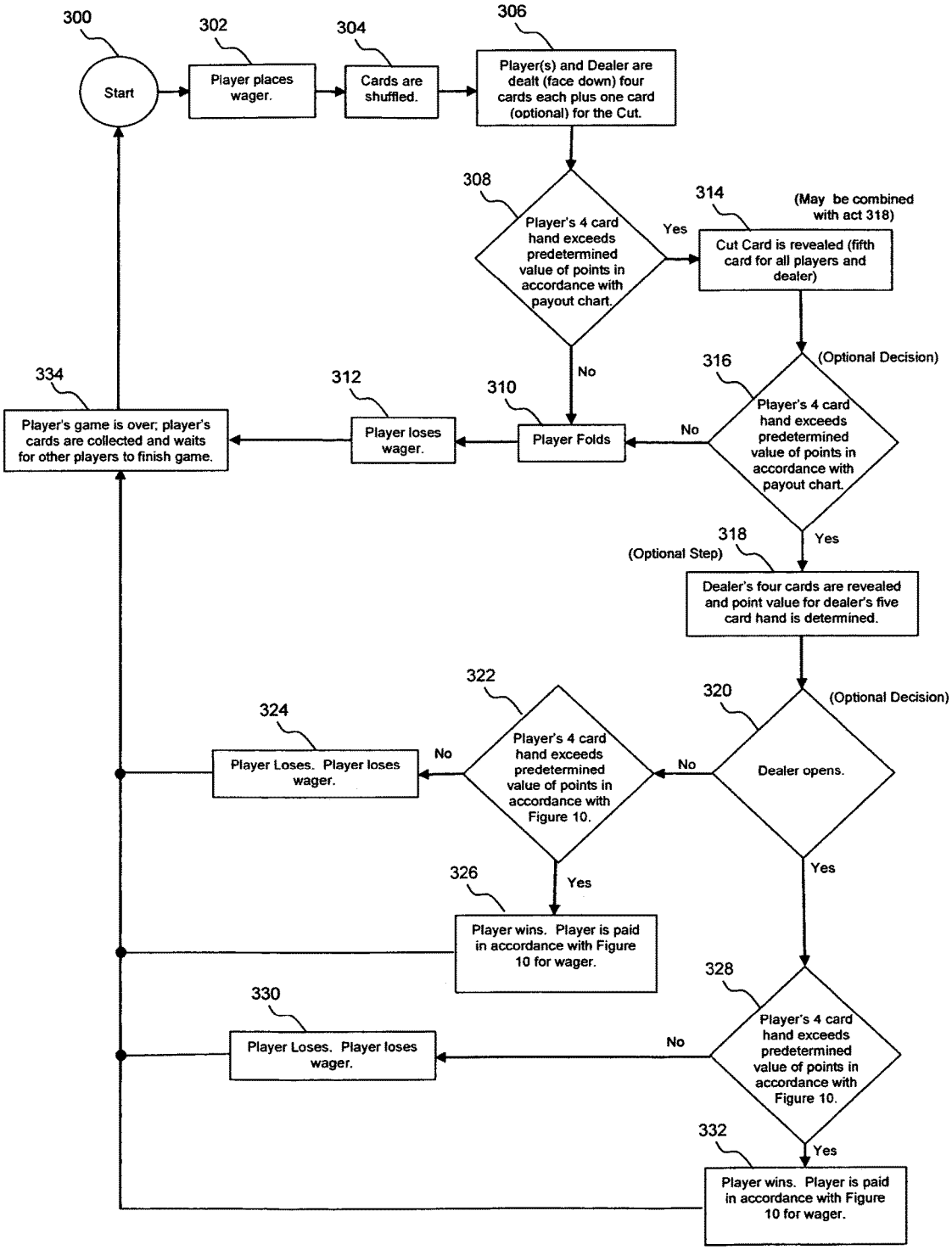
FIG. 5 is a logic table illustrating the logic flow for a single wagering system where the player is wagering only on the first four cards.

FIG. 5 is a flow chart representation of the above embodiment of the game according to the present system where there is a single wagering system. The game starts at act 300 indicating a new game. At act 302, the player places a wager indicating that the player is in the game. The cards are shuffled at act 304 and four cards are dealt (face down) to each player and dealer with one card being dealt (face down) to the "cut" at act 306. At act 308, the player makes a decision as to whether his/her hand is worth continuing on with and can either stay or fold. If the player desires to fold, at act 310, the player will fold, the dealer will collect the wager at act 312 and the player's cards will be collected and the game will be over until all other players have played out their hands at act 334.

If the player decides to continue in the game at act 308, the cut card will then be revealed at act 314 where that card will now be represented in only the dealer's hand for a five card hand. (Act 314 may be combined with act 318 if the optional step 316 is not used.) At act 316 (optional step), the player makes a decision as to whether his/her hand is worth continuing on with and can either stay or fold. If the player desires to fold, at act 310, the player will fold, the dealer will collect the wager at act 312 and the player's cards will be collected and the game will be over until all other players have played out their hands at act 334.

At act 318 (optional step) the dealer will reveal his/her four cards and with the cut card determine the value of his/her five card hand. At act 320 (optional step) if the dealer's hand exceeds a predetermined value (generally four points) the dealer will open. If the dealer's hand does not exceed the predetermined value, the dealer will not open. When the dealer does not open at act 322 it is determined if the player's hand exceeds the odds payout chart for a single wager game (FIG. 10). If the player hand does not exceed the odds payout chart, the player loses at act 324 and the dealer collects the player's wager. At act 334 the game is over for the player, his/her cards are collected and the player will wait for all other players to finish their game.

At act 322 it is determined if the player's hand meets or exceeds the odds payout chart for a single wager game found in FIG. 10. If the player hand does meet or exceed the odds payout chart, the player wins at act 326 and is paid the odds found in FIG. 10. At act 334 the game is over for the player, his/her cards are collected and the player will wait for all other players to finish their game.

At act 320 (optional step) if the dealer's hand meets or exceeds a predetermined value (generally four points) the dealer will open. If the dealer's hand does meet or exceed the predetermined value, the dealer opens and at act 328 it is determined if the player's hand meets or exceeds the odds payout chart for a single wager game found in FIG. 10. If the player hand does not meet or exceed the odds payout chart, the player loses at act 330 and the dealer collects the player's wager. At act 334 the game is over for the player, his/her cards are collected and the player will wait for all other players to finish their game.

At act 328 it is determined if the player's hand meets or exceeds the odds payout chart for a single wager game found in FIG. 10. If the player hand does meet or exceed the odds payout chart, the player wins at act 332 and is paid the odds found in FIG. 10. At act 334 the game is over for the player, his/her cards are collected and the player will wait for all other players to finish their game. A new game then starts again at act 300.

In another embodiment of the Applicant's game (10) may require an "ante" (15) prior to receiving a hand dealt from the dealer. In such a case, the "ante" (15) is actually the first wager made by a player and the "First Four" (37) would become the second wager. In this embodiment, the "ante" (15) would only be paid if the dealer opens, pushed if the dealer does not open, or would be lost if the player loses the "First Four" (37) wager. Thereafter the game is played as described above.

In yet another embodiment of the system with specific reference to FIGS. 1 and 2, the game (10) of the present invention includes the same game board (12). Game board (12), according to this embodiment, includes an area (34) for players to place a first wager as will be fully described and disclosed hereafter.

FIG. 1 shows that game board (12) has places for seven separate players (players not shown). Each place for a player preferably is identical to the other places on a particular game board (12) for consistency and to prevent confusion. Obviously, game board (12) may contain any number of player positions now known or hereafter developed and desired.

FIG. 1 also shows an area (20) for the placement of a common last card, area (22) for the placement of the dealer's cards. FIG. 1 also shows area (28) located in front of a dealer location (29) (dealer not shown) upon which a dealer may shuffle cards. Area (30) shows the general location for collected cards and area (31) shows the general location of a chip tray. Area (40) is a general location for selected rules to be displayed and area (41) shows the requirements for the dealer to open. Areas (36) and (38) are for additional embodiments of said system. Cards are a normal/standard deck of 52 cards divided into the usual four suits of thirteen cards each. The normal deck of cards are used so as to allow for the application of the normal rules of said game, as those of ordinary skill in the art should be aware of and familiar with, in determining the value of a hand. Certainly, other types of cards with other numbers and/or pictures may be used in the game and the general rules of said game are applied.

Referring now to FIG. 2, a preferred embodiment of the layout for a single player's location or position at game board (12), as shown in FIG. 1, is illustrated. As shown in FIG. 2, the first wager area (14), second wager area (16), and third wager area (18) may or may not be utilized. In this embodiment, only area (34) will be utilized. The player faces the dealer location (29), as shown in FIG. 1, and according to this embodiment, places a first wager on the "Nobs" (35) in the wager area (34) in order to participate in the hand. All the players that make a wager are then dealt several cards face down. According to a preferred embodiment, four cards are dealt (face down) to each player making a first wager and four cards are dealt (face down) to the dealer with one card being dealt (face down) in area (20) of FIG. 1. Here, the player determines whether his/her initial four cards, again preferably, merits continuing with the game or not. If the player folds, he/she loses his/her wager "Nobs" (35) and the game for that player is over.

If the player continues with the game, an additional common last card (21) of FIG. 1, (called the "cut card") will be placed face up in area (20) of FIG. 1. In a preferred four card deal, the common last card (21) of FIG. 1 is the fifth card and is used by all remaining players and the dealer. Once the "cut card" is revealed, the dealer exposes the dealer's four cards face up (optional) in area (22) of FIG. 1, in front of the dealer location (29) of FIG. 1, to all the remaining players still in the game. The dealer then determines the point value in the dealer's hand, including the cut card (21) of FIG. 1, in area (20) of FIG. 1 based on the counting rules described in the summary of this system. If the player's hand does not contain a jack with a matching suit of the "cut card," as determined in a single wager "Nobs" game, the player loses the wager, "Nobs" (35). If the player's hand contains the jack with a matching suit of the "cut card," as determined in a single wager "Nobs" game, the player wins the game and the dealer pays the player for the "Nobs" (35) where the game pays out odds in accordance with the single wagering "Nobs" table found in FIG. 11. There are no draw situations in this embodiment. Players are playing for odds payout in FIG. 11 only and not against the dealer's hand or against any other players.

According to one embodiment, the dealer's hand must be worth a predetermined minimum in order to "open" or continue the hand. According to one embodiment, the dealer must have at least four points or more, according to the counting rules described in the summary of this system, for the game to be considered open. According to one embodiment, if the dealer's hand, including the last common card (21) of FIG. 1, does not have at least four points, the dealer does not open.

After all payouts and collections have been completed, the game is over, the cards are reshuffled and a new game is begun.

Figure 6:
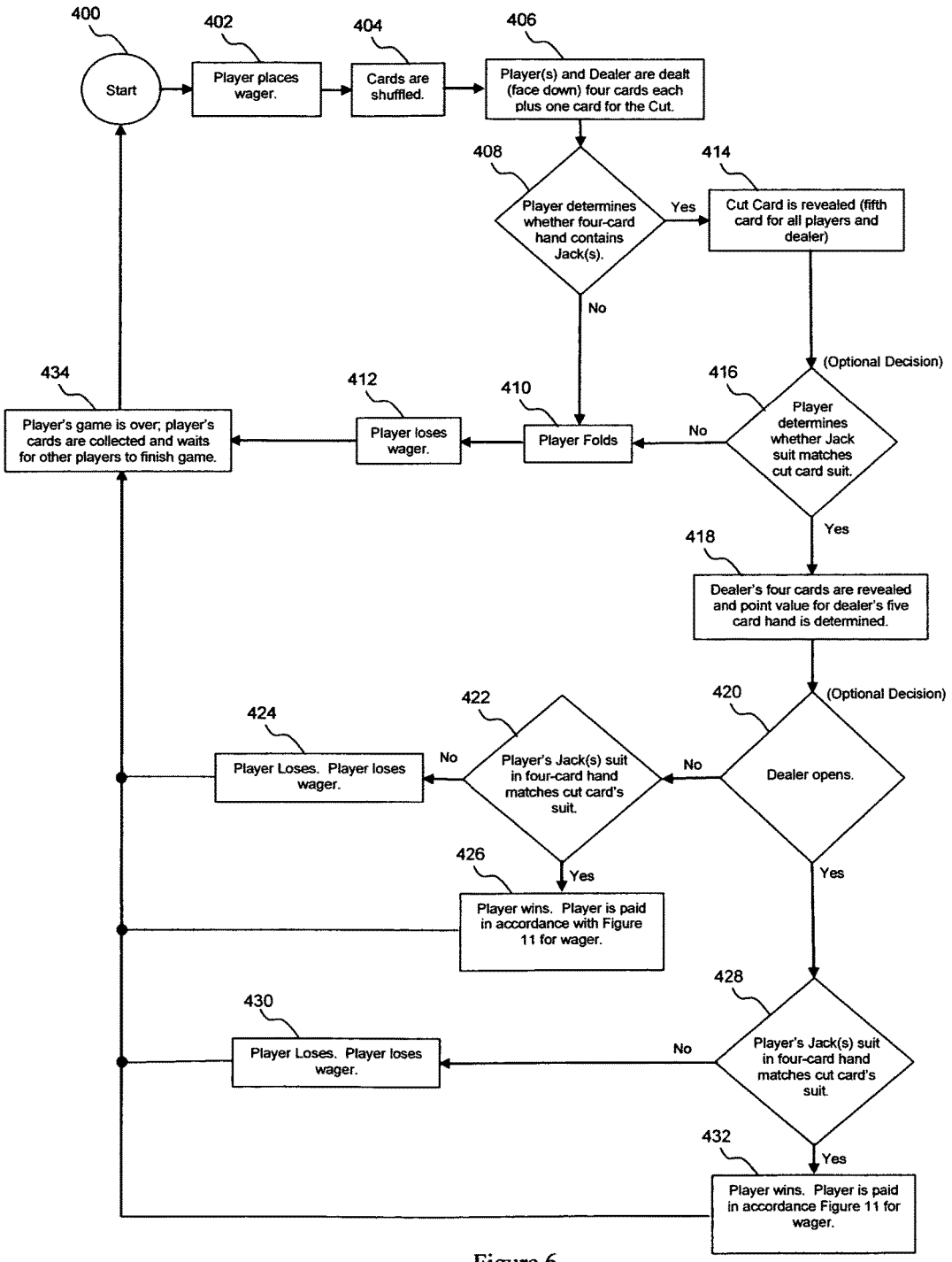
FIG. 6 is a logic table illustrating the logic flow for a single wagering system where the player is wagering only on a specific hand combination using Jacks in his/her hand and the suit of the fifth (cut) card.

FIG. 6 is a flow chart representation of the above embodiment of the game according to the present system where there is a single wagering system. The game starts at act 400 indicating a new game. At act 402, the player places a wager indicating that the player is in the game. The cards are shuffled at act 404 and four cards are dealt (face down) to each player and dealer with one card being dealt (face down) to the "cut" at act 406. At act 408, the player makes a decision as to whether his/her hand contains one or more jacks and can either stay or fold. If the player desires to fold, at act 410, the player will fold, the dealer will collect the wager at act 412 and the player's cards will be collected and the game will be over until all other players have played out their hands at act 434.

If the player decides to continue in the game at act 408, the "cut card" will then be revealed at act 414 where that card will now be represented in all players' hands and the dealer's hand for a five card hand. At act 416 (optional decision) the player makes a decision as to whether his/her hand is worth continuing on with and can either stay or fold. If the player desires to fold, at act 410, the player will fold, the dealer will collect the wager at act 412 and the player's cards will be collected and the game will be over until all other players have played out their hands at act 434.

At act 418 (optional step) the dealer will reveal his/her four cards and with the cut card determine the value of his/her five card hand. At act 420 (optional decision) if the dealer's hand exceeds a predetermined value (according to one embodiment; four points) the dealer will open. If the dealer's hand does not exceed the predetermined value, the dealer will not open. At act 422 it is determined if the player's hand contains a jack where the jack's suit matches the suit of the "cut card." If the player's hand does not contain a jack where the jack's suit matches the suit of the "cut card," the player loses at act 424 and the dealer collects the player's wager. At act 434 the game is over for the player, his/her cards are collected and the player will wait for all other players to finish their game.

At act 422 it is determined if the player's hand contains a jack where the jack's suit matches the suit of the "cut card." If the player's hand does contain a jack where the jack's suit matches the suit of the "cut card," the player wins the game and at act 426 is paid out odds in accordance with FIG. 11. At act 434 the game is over for the player, his/her cards are collected and the player will wait for all other players to finish their game.

At act 420 (optional decision) if the dealer's hand exceeds a predetermined value (according to one embodiment; four points) the dealer will open. If the dealer's hand does exceed the predetermined value, the dealer opens. At act 428 it is determined if the player's hand contains a jack where the jack's suit matches the suit of the "cut card." If the player's hand does not contain a jack where the jack's suit matches the suit of the "cut card," the player loses at act 430 and the dealer collects the player's wager. At act 434 the game is over for the player, his/her cards are collected and the player will wait for all other players to finish their game.

At act 428 it is determined if the player's hand contains a jack where the jack's suit matches the suit of the cut card. If the player's hand does contain a jack where the jack's suit matches the suit of the cut card, the player wins the game and at act 432 is paid out odds in accordance with FIG. 11. At act 434 the game is over for the player, his/her cards are collected and the player will wait for all other players to finish their game.

In another embodiment of the Applicant's game (10) may require an "ante" (15) prior to receiving a hand dealt from the dealer. In such a case, the "ante" (15) is actually the first wager made by a player and the "Nobs" (35) would become the second wager. In this embodiment, the "ante" (15) would only be paid if the dealer opens, pushed if the dealer does not open, or would be lost if the player loses the "Nobs" (35) wager. Thereafter the game is played as described above.

In yet another embodiment of the system with specific reference to FIGS. 1 and 2, the game (10) of the present invention includes the same game board (12). Game board (12), according to this embodiment, includes an area (38) for players to place a first wager as will be fully described and disclosed hereafter.

FIG. 1 shows that game board (12) has places for seven separate players (players not shown). Each place for a player preferably is identical to the other places on a particular game board (12) for consistency and to prevent confusion. Obviously, game board (12) may contain any number of player positions now known or hereafter developed and desired.

FIG. 1 also shows an area (20) for the placement of a common last card, area (22) for the placement of the dealer's cards. FIG. 1 also shows area (28) located in front of a dealer location (29) (dealer not shown) upon which a dealer may shuffle cards. Area (30) shows the general location for collected cards and area (31) shows the general location of a chip tray. Area (40) is a general location for selected rules to be displayed and area (41) shows the requirements for the dealer to open. Areas (34) and (36) are for additional embodiments of said system. Cards are a normal/standard deck of 52 cards divided into the usual four suits of thirteen cards each. The normal deck of cards are used so as to allow for the application of the normal rules of said game, as those of ordinary skill in the art should be aware of and familiar with, in determining the value of a hand. Certainly, other types of cards with other numbers and/or pictures may be used in the game and the general rules of said game are applied.

Referring now to FIG. 2, a preferred embodiment of the layout for a single player's location or position at game board (12), as shown in FIG. 1, is illustrated. As shown in FIG. 2, the first wager area (14), second wager area (16), and third wager area (18) may or may not be utilized. In this embodiment, only area (38) will be utilized. The player faces the dealer location (29), as shown in FIG. 1, and according to this embodiment, places a first wager on the "Bonus" (39) in the first wager area (38) in order to participate in the hand. All the players that make a first wager are then dealt several cards face down. According to a preferred embodiment, four cards are dealt (face down) to each player making a first wager and four cards are dealt (face down) to the dealer with one card dealt (face down) in area (20) of FIG. 1. Here, the player determines whether his/her initial four cards, again preferably, merits continuing with the game or not. If the player folds, he/she loses his/her wager "Bonus" (39) and the game for that player is over.

If the player continues with the game, an additional common last card (21) of FIG. 1, (called the "cut card") will be placed face up in area (20) of FIG. 1. In a preferred four card deal, the common last card (21) of FIG. 1 is the fifth card and is used by all remaining players and the dealer. Once the "cut card" is revealed, the dealer exposes the dealer's four cards face up (optional) in area (22) of FIG. 1, in front of the dealer location (29) of FIG. 1, to all the remaining players still in the hand. The dealer then determines the point value in the dealer's hand, including the cut card (21) of FIG. 1, in area (20) of FIG. 1 based on the counting rules described in the summary of this system. If the player's hand contains fewer points or no values than what is determined in a single wager game in FIG. 12, the player loses the wager "Bonus" (39). If the player's hand contains the same or more points or matches values as what is determined in a single wager game according to FIG. 12, the dealer pays the player the "Bonus" (39) where the game pays out odds in accordance with the single wagering table found in FIG. 12. There are no draw situations in this embodiment. Players are playing for odds found in FIG. 12 only and not against the dealer's hand or against any other players.

According to one embodiment, the dealer's hand must be worth a predetermined minimum in order to "open" or continue the hand. According to one embodiment, the dealer must have at least four points or more, according to the counting rules described in the summary of this system for the game to be considered "open." According to one embodiment, if the dealer's hand, including the last common card (21) of FIG. 1, does not have at least four points, the dealer does not "open."

After all payouts and collections have been completed, the game is over, the cards are reshuffled and a new game can begin.

Figure 7:
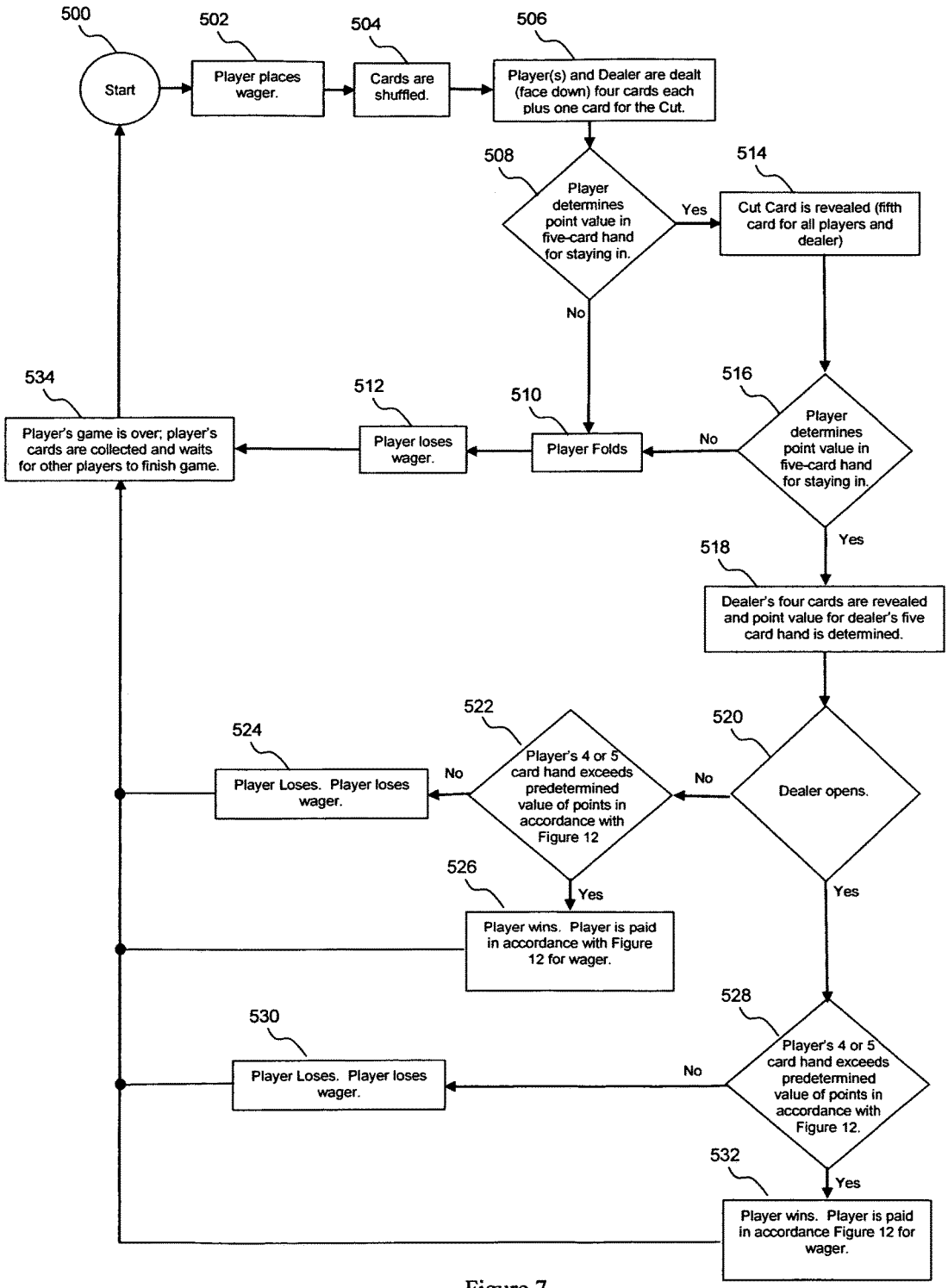
FIG. 7 is a logic table illustrating the logic flow for a single wagering system where the player is wagering only on specific combinations of his/her four and five card hands.

FIG. 7 is a flow chart representation of the above embodiment of the game according to the present system where there is a single wagering system. The game starts at act 500 indicating a new game. At act 502, the player places a wager indicating that the player is in the game. The cards are shuffled at act 504 and four cards are dealt out to each player and dealer with one card being dealt to the "cut" at act 506. At act 508, the player makes a decision as to whether his/her hand is worth continuing on with and can either stay or fold. If the player desires to fold, at act 510, the player will fold, the dealer will collect the wager at act 512 and the player's cards will be collected and the game will be over until all other players have played out their hands at act 534.

If the player decides that his/her hand has sufficient value as to continue, the player will stay and the "cut card" will then be revealed at act 116 where that card will now be represented in all player's hands and the dealer's hand for a five card hand. At act 516 the player must now make a decision as to whether his/her hand is worth continuing on with and can either stay or fold. If the player desires to fold, at act 510, the player will fold and the dealer will collect the wager at act 512. The player's cards will be collected and the game will be over until all other players have played out their hands at act 534.

If the player decides that his/her hand has sufficient value as to continue, the player will stay and at act 518 (optional step) the dealer will reveal his/her four cards and with the "cut card" determine the value of his/her five card hand. At act 520 (optional decision) if the dealer's hand exceeds a predetermined value (according to one embodiment; four points) the dealer will open. If the hand does not exceed the predetermined value, the dealer will not open. At act 522 it is determined whether the player's four or five card hand meets or exceeds the odds payout chart for a single wager game as shown in FIG. 12. If the player hand does not meet or exceed the odds payout chart, the player loses at act 524 and the dealer collects the player's wager. At act 534 the game is over for the player, his/her cards are collected and the player will wait for all other players to finish their game.

At act 522 it is determined whether the player's four or five card hand meets or exceeds the odds payout chart for a single wager game as shown in FIG. 12. If the player hand does meet or exceed the odds payout chart, the player wins at act 526 and is paid the odds shown in FIG. 12. At act 534 the game is over for the player, his/her cards are collected and the player will wait for all other players to finish their game.

At act 520 (optional decision) if the dealer's hand exceeds a predetermined value (according to one embodiment; four points) the dealer will open. If the hand does exceed the predetermined value, the dealer opens and at act 528 it is determined whether the player's four or five card hand meets or exceeds the odds payout chart for a single wager game as shown in FIG. 12. If the player hand does not meet or exceed the odds payout chart, the player loses at act 530 and the dealer collects the player's wager. At act 534 the game is over for the player, his/her cards are collected and the player will wait for all other players to finish their game.

At act 528 it is determined whether the player's four or five card hand meets or exceeds the odds payout chart for a single wager game as shown in FIG. 12. If the player hand does meet or exceed the odds payout chart, the player wins at act 532 and is paid the odds as shown in FIG. 12. At act 534 the game is over for the player, his/her cards are collected and the player will wait for all other players to finish their game. A new game then starts again at act 500.

In another embodiment of the Applicant's game (10) may require an "ante" (15) prior to receiving a hand dealt from the dealer. In such a case, the "ante" (15) is actually the first wager made by a player and the "Bonus" (39) would become the second wager. In this embodiment, the "ante" (15) would only be paid if the dealer opens, pushed if the dealer does not open, or would be lost if the player loses the "Bonus" (39) wager. Thereafter the game is played as described above.

Obviously, while the game has been described in connection with a physical game board 12 as used in casinos, Applicant's game is well suited for presentation in any other form such as in a mechanical, electronic or video game device. Such game devices, electrical mechanical devices, electronic poker machines and/or internet gaming sites, are well within the ordinary skill of those in the art for the adaptation of Applicant's system as described herein.

The hallmark of Applicant's game is the combination of the three-tier wagering system and dealing (according to embodiments) only four cards in accordance to counting and payout principles aforementioned. This technique allows an excellent opportunity for players to wager a small amount in order to win a large amount of money. Also, Applicant's game includes an element of risk with an increase to player decision making. As presented herein, the Applicant's game 10 may be considered a worthy contender and welcome substitute to regular casino type card games like blackjack, baccarat, and poker.

While the present invention has been disclosed in connection with the preferred embodiment thereof, it should be understood that there might be other embodiments that fall within the spirit and scope of the invention as defined by the following claims.

What is claimed is:

1. Computer code on a non-transitory computer readable medium for use in a computer for facilitating a method of playing a wagering card game; wherein said wagering card game includes a specific element of counting points utilizing the standard counting technique of cribbage in hand values, a specific element of wagering where wagers accumulate and build upon one another, with said wagering card game being played between a dealer and one or more players, where the dealer deals from a single standard deck of 52 cards and payout odds are predetermined, the method of playing consisting of the steps of;

a. each player elects to play said card game by placing a first wager;

b. then the dealer deals face down a predetermined number of cards, four cards, to all those players who elected to play and the same predetermined number of cards to the dealer;

c. a single card is dealt face down; which will constitute as the last, fifth, card for all players including the dealer;

d. then before the dealer turns over the last card, players count the value of their hand according to general cribbage counting procedures and make a determination whether to place a second wager or fold;

e. the dealer will collect said first and cards from players who fold and then reveals the last card which will be utilized as a common last card;

f. where the player will count the value of their hand and make a determination whether to place a third wager or fold;

g. the dealer will collect said second wagers and cards from players who fold and then reveal the dealer's cards;

h. the dealer then counts the full five card point value of the dealer's hand according to general cribbage counting procedures;

i. the dealer then counts each remaining player's full five card hand according to general cribbage counting procedures;

j. then the dealer makes a determination where the dealer's hand must exceed a predetermined number of points or contain a certain combination of cards, according to standard cribbage counting procedures, in order for the dealer to be considered open thus creating possible payouts for the first and second wagers when the dealer opens, and k. then, according to said wagering card game rules of counting cribbage-style hand values, the dealer makes payouts to the first and second wagers plus payouts of predetermined payout odds for the third wager to all said players whose hands exceed the value of the dealer's hand, collects first, second and third wagers from all said players whose hands values are less than the dealer's hand or pushes first, second and third wagers on hands that tie the dealer's hand.

2. The method according to claim 1 where the predetermined payout odds are:

a. 4-10 points is 1 to 1;
b. 11-12 points is 2 to 1;
c. 13-14 points is 3 to 1;
d. 15-16 points is 6 to 1;
e. 17-18 points is 8 to 1;
f. 20-22 points is 16 to 1;
g. 23-24 points is 25 to 1;
h. 28 points is 50 to 1; and
i. 29 points is 200 to 1.

3. The method according to claim 1 where the dealer's five card hand must contain at least four points to be considered open.

4. The method according to claim 1 where the dealer turns over the dealer's last card of the predetermined cards so as to reveal its value.

5. The method according to claim 1 where the third wager is selected from a group consisting of: one-half, equal to or twice that of the second wager.

6. The method according to claim 1 where the second wager is selected from a group consisting of: one-half, equal to, or twice that of the first wager.

7. The method according to claim 1 wherein said wagering card game is conducted in a casino setting.

8. The method of claim 1 wherein said game is a simulated game played on a mechanical, electronic or video game device.

9. Computer code on a non-transitory computer readable medium for use in a computer for facilitating a method of playing a wagering card game, wherein said wagering card game includes a specific element of counting points utilizing the standard counting technique of cribbage in hand values, a specific element of wagering where wagers accumulate or build upon one another, with said wagering card game being played between a dealer and one or more players, where the dealer deals from a single standard deck of 52 cards and payout odds are predetermined, consisting of;

a. each player elects to play said wagering card game by placing a first wager;

b. then the dealer deals face down a predetermined number of cards, four cards, to all those players who elected to play and the same predetermined number of cards to the dealer;

c. a single card is dealt lace down which constitutes the last, fifth card for all players including the dealer;

d. then, before the dealer turns over the last card, players count the value of their hand and make a determination whether to place a second wager or fold;

e. the dealer collects wagers and cards from players who fold and then reveals the last card which is utilized as a common card;

f. the dealer counts the full point value of the dealer's hand including said common card according to general cribbage counting procedures;

g. the dealer then counts each remaining player's full hand including said common card according to general cribbage counting procedures;

h. plus the dealer must make a determination where the dealer's hand must exceed a predetermined number of points or contain a certain combination of cards, according to standard cribbage counting procedures, in order for the dealer to be considered open, thus creating possible payouts for the first wager when the dealer opens, and i. according to said wagering card game rules of counting cribbage-style hand values, the dealer makes payouts to the first wager plus payouts of predetermined payout odds for the second wager to all said players whose hands exceed the value of the dealer's hand, collects first and second wagers from all said players whose hands values are less than the dealer's hand or pushes first and second wagers on hands that tie the dealer's hand.

10. The method according to claim 9 where the predetermined payout odds are:

a. 4-10 points is 1 to 1;

b. 11-12 points is 2 to 1;

c. 13-14 points is 4 to 1;

d. 15-16 points is 8 to 1;

e. 17-18 points is 10 to 1;

f. 20-22 points is 20 to 1;

g. 23-24 points is 25 to 1;

h. 28 points is 50 to 1; and i. 29 points is 200 to 1.

11. The method according to claim 9 where the dealer's hand must contain at least four points to be considered open.

12. The method according to claim 9 where the dealer turns over the dealer's last card of the said predetermined cards as to reveal its value.

13. The method according to claim 9 comprising the further step of providing players a surface which includes a plurality of betting areas, where each of said plurality of betting areas is adapted for use by one player and each betting area comprises of a set of up to six sub areas respectively for all possible wagers.

14. The method according to claim 9 where the second wager is selected from a group consisting of: one-half, equal to, or twice tat of the first wager.

15. The method according to claim 9 wherein said wagering card game is conducted in a casino setting.

16. The method of claim 9 wherein said wagering card game is a simulated game played on a mechanical, electronic or video game device.

17. Computer code on a computer readable medium for use in a non-transitory computer for facilitating a method of playing a wagering card game, wherein said wagering card game includes a specific element of counting points utilizing the standard counting technique of cribbage in hand values with said wagering card game being played between a dealer and one or more players, where the dealer deals from a single standard deck of 52 cards and payout odds are predetermined, the method of playing consisting of the steps of;

a. each player elects to play said wagering card game by placing a first wager, b. then the dealer deals face down a predetermined number of cards, four cards, to all those players who elected to play and the same predetermined number of cards to the dealer, c. a single card is dealt face down, which constitutes the last card, fifth card, for all players including the dealer, d. then, before the dealer turns over the last card, players will count the value of their hand and make a determination whether to stay and place a second wager or fold;

e. the dealer collects the first wagers and cards from players who fold;

f. the dealer then reveals the last card and also reveals the dealer's cards;

g. the dealer counts the full point value of the dealer's hand including the last card according to general cribbage counting procedures;

h. the dealer then counts each remaining player's hand not including the last card according to standard cribbage counting procedures; and i. according to wagering card game rules of counting cribbage-style hand values, the dealer makes payouts to players meeting or exceeding four card hand values from predetermined payout odds tables or collects from all other said players.

18. The method according to claim 17 where the predetermined payout odds are:

a. 5 points is 1 to 1;

b. 6 points is 3 to 1;

c. Four Card Flush is 5 to 1;

d. 7-8 points is 7 to 1;

e. 9-10 points is 10 to 1;

f. 11-12 points is 15 to 1;

g. 13-14 points is 20 to 1; and h. 20 points is 100 to 1.

19. The method according to claim 17 where an ante wager is required prior to receiving a hand dealt from a dealer wherein said ante wager is selected from a group of wager options consisting of;

a. the ante wager is paid if the dealer opens;

b. the ante wager pushes if the dealer does not open; and c. the ante wager is lost if the player loses said wagering card game.

20. The method according to claim 19, wherein the dealer's hand must exceed a predetermined number of points in order for the dealer to be considered open.

21. The method according to claim 19, wherein the dealer's hand must contain a certain combination of cards in order for the dealer to be considered open.

22. The method according to claim 17 where each of said plurality of areas is adapted for use by one player and each area consists of a set of up to six sub areas respectively for all possible wagers.

23. The method according to claim 17 wherein said wagering card game is conducted in a casino setting.

24. The method according to claim 17 wherein said game is a simulated game played on a mechanical, electronic or video game device.

25. Computer code on a non-transitory computer readable medium for use in a computer for facilitating a method of playing a wagering card game, wherein said wagering card game includes a specific element of counting points utilizing the standard counting technique of cribbage in hand values with said wagering card game being played between a dealer and one or more players, where the dealer deals from a single standard deck of 52 cards and payout odds are predetermined, consisting of;

a. each player elects to play said wagering card game by placing a first wager;

b. then the dealer deals face down a predetermined number of cards, four cards, to all those players who elected to play and the same predetermined number of cards to the dealer;

c. a single card is dealt face down which constitutes the last card, fifth card, for all players including the dealer;

d. then, before the dealer turns over the last card, players look for jacks in their hand and make a determination whether to stay or fold;

e. the dealer collects wagers and cards from players who fold;

f. the dealer then reveals the last card;

g. the player then decides whether the jack's suit in their hand matches that of the suit of the last card and makes a determination whether to stay or fold;

h. the dealer collects wagers and cards from players who fold and then reveals the dealer's cards;

i. the dealer counts the full point value of the dealer's hand including the last card according to standard cribbage counting procedures;

j. then the dealer determines whether each remaining player's hand contains a jack with the matching suit of the last card; and k. according to wagering card game rules the dealer makes payouts to all said players whose hands contains the jack that matches the suit of the last or common card and collects from all said players whose hands do not match.

26. The method according to claim 25 where the predetermined payout odds for a hand containing a matching jack are:

a. Matching Jack's Suit is 10 to 1.

27. The method according to claim 25 where an ante wager is required prior to receiving a hand dealt from a dealer wherein the ante wager is selected from a group of wagers consisting of;

a. the ante wager is only be paid if the dealer opens;

b. the ante wager pushes if the dealer does not open; and c. the ante wager is lost if the player loses said wagering game.

28. The method according to claim 27, wherein the dealer's hand must exceed a predetermined number of points in order for the dealer to be considered open creating additional payouts for wagers.

29. The method according to claim 27, wherein the dealer's hand must contain a certain combination of cards in order for the dealer to be considered open creating additional payouts for wagers.

30. The method according to claim 25 comprising the further step of providing players a surface which includes a plurality of betting areas, where each area of said plurality of betting areas is adapted for use by one player and each betting area comprises of a set of up to six sub areas respectively for all possible wagers.

31. The method according to claim 25 wherein said wagering card game is conducted in a casino setting.

32. The method according to claim 25 wherein said game is a simulated game played on a mechanical, electronic or video game device.

33. Computer code on a non-transitory computer readable medium for use in a computer for facilitating a method of playing a wagering card, wherein said wagering card game includes a specific element of counting points utilizing the standard counting technique of cribbage in hand values with said wagering card game being played between a dealer and one or more players, where the dealer deals from a single standard deck of 52 cards and payout odds are predetermined, the method of playing consisting of the steps of;

a. each player elects to play said wagering card game by placing a first wager;

b. then the dealer deals face down a predetermined number of cards, four cards, to all those players who elected to play and the same predetermined number of cards to the dealer;

c. a single card is dealt face down; which constitutes the last card, fifth card, for all players including the dealer;

d. then, before the dealer turns over the last card, players count the value of their hand and make a determination whether to stay or fold;

e. the dealer collects said first wagers and cards from players who fold;

f. then the dealer reveals the last card;

g. the player counts the value of both their predetermined cards and predetermined cards with the last card and makes a determination whether to stay and place a third wager or fold;

h. the dealer collects said second wagers and cards from players who fold and then reveals the dealer's cards;

i. the dealer then counts the final point value of the dealer's hand including the final card according to standard cribbage counting procedures;

j. then the dealer counts each remaining player's predetermined cards and predetermined cards with the last card according to standard cribbage counting procedures; and k. according to wagering card game rules the dealer makes payouts to all said players whose hands match or exceed the predetermined payout odds according to the standard counting procedures of cribbage or collects from all said players whose hands do not match or exceed the predetermined payout odds.

34. The method according to claim 33 where the predetermined payout odds are:

a. Four Card Flush (in original predetermined cards) is $35;

b. Five Card Flush is $100;

c. 20-22 points is $125;

d. 23-24 points is $250;

e. Four 5's (in original predetermined cards) is $1,500;

f. 28 points is $2,500 (or 5% of pool); and g. 29 points is $50,000 (or 100% of pool).

35. The method according to claim 33 where an ante wager is required prior to receiving a hand dealt from a dealer wherein the ante wager is selected from a group of wagers consisting of;

a. the ante wager is only paid if the dealer opens;

b. the ante wager pushes if the dealer does not open; and c. the ante wager is lost if the player loses said wagering game.

36. The method according to claim 35, wherein the dealer's hand must exceed a predetermined number of points in order for the dealer to be considered open creating additional payouts for wagers.

37. The method according to claim 35, wherein the dealer's hand must contain a certain combination of cards in order for the dealer to be considered open creating additional payouts for wagers.

38. The method according to claim 33 wherein said wagering card game is conducted in a casino setting.

39. The method according to claim 33 wherein said game is a simulated game played on a mechanical, electronic or video game device.

* * * * *